United States Patent [19]

Meives et al.

[11] Patent Number: 4,480,422

[45] Date of Patent: Nov. 6, 1984

[54] APPARATUS FOR PACKAGING STACKS OF SHEET MATERIAL

[75] Inventors: Otis E. Meives, Cleveland, Wis.; Larry L. Verhyen, deceased, late of Sheboygan, Wis., by Kathleen L. Verhyen, special administrator; Jerome L. Hickmann, Sheboygan, Wis.

[73] Assignee: Pemco, Inc., Sheboygan, Wis.

[21] Appl. No.: 258,173

[22] Filed: Apr. 27, 1981

[51] Int. Cl.[3] ..... B65B 11/00

[52] U.S. Cl. ..... 53/207; 53/374; 493/309

[58] Field of Search ..... 53/207–209, 53/374, 458, 462, 491, 206, 537, 460; 493/309

[56] References Cited

U.S. PATENT DOCUMENTS 2,974,461 3/1961 Demler ..... 53/209 X 3,454,149 7/1969 Nigrelli ..... 53/207 X 3,471,994 10/1969 Cranston ..... 53/209

*Primary Examiner*—A. J. Heinz

*Attorney, Agent, or Firm*—Peter K. Kontler

[57] ABSTRACT

An apparatus is disclosed for packaging large stacks of sheet material such as reams (10) of folio-sized paper. The reams are positioned on a precut bottom carton blank (24) and conveyed to a folding station (110). A top carton blank (50) is then positioned on the upper surface of the ream. Then peripheral flaps (34, 36, 42, 44, 46, 48) on the bottom carton blank are folded upward adjacent the sides of the ream. The preglued side flaps (58, 60) and end flaps (70, 72) of the top carton blank are folded downward into contact with the flaps of the bottom carton blank. All folding operations are performed as the ream moves along an essentially straight path through the apparatus, thus providing a compact packaging system.

54 Claims, 36 Drawing Figures

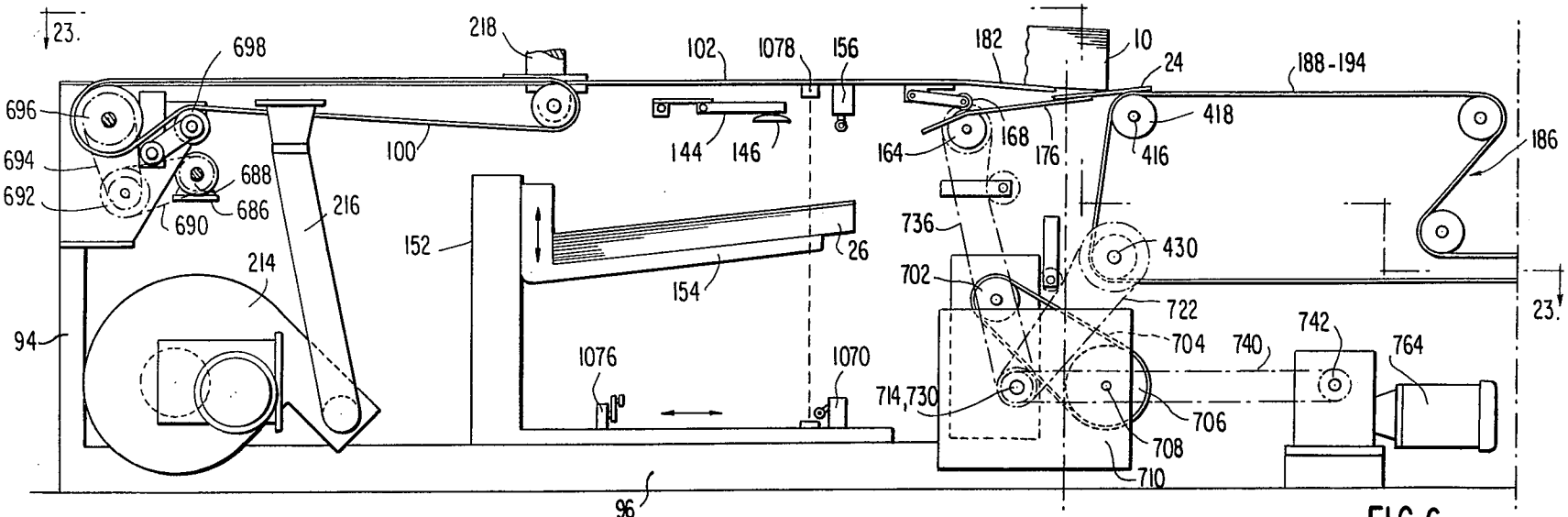
FIG. 6
FIG. 7
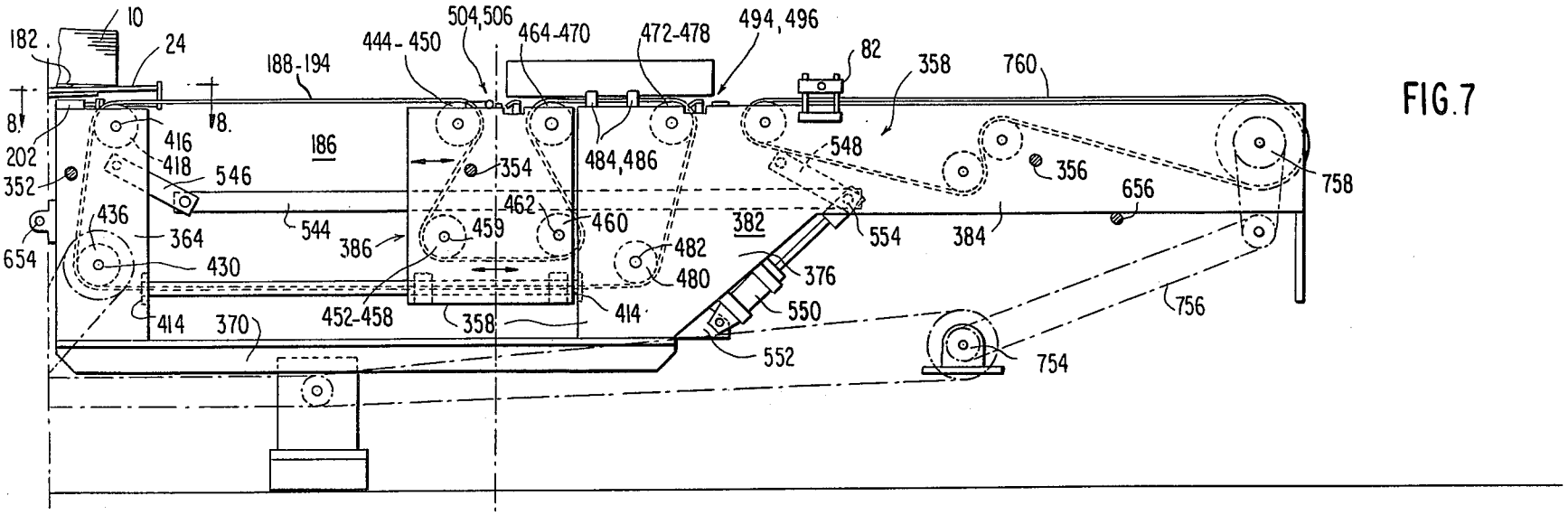

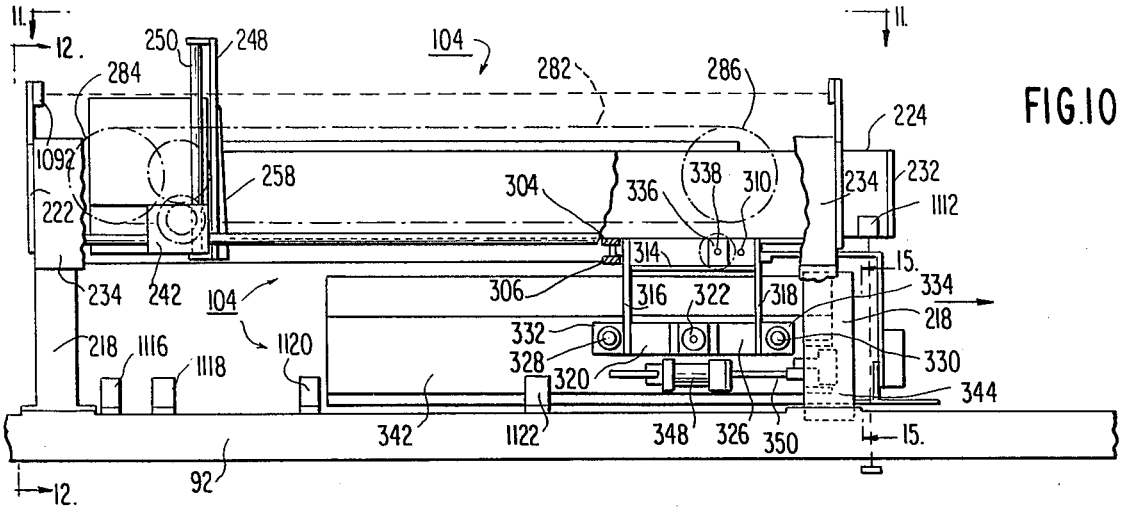
FIG.10
FIG.11
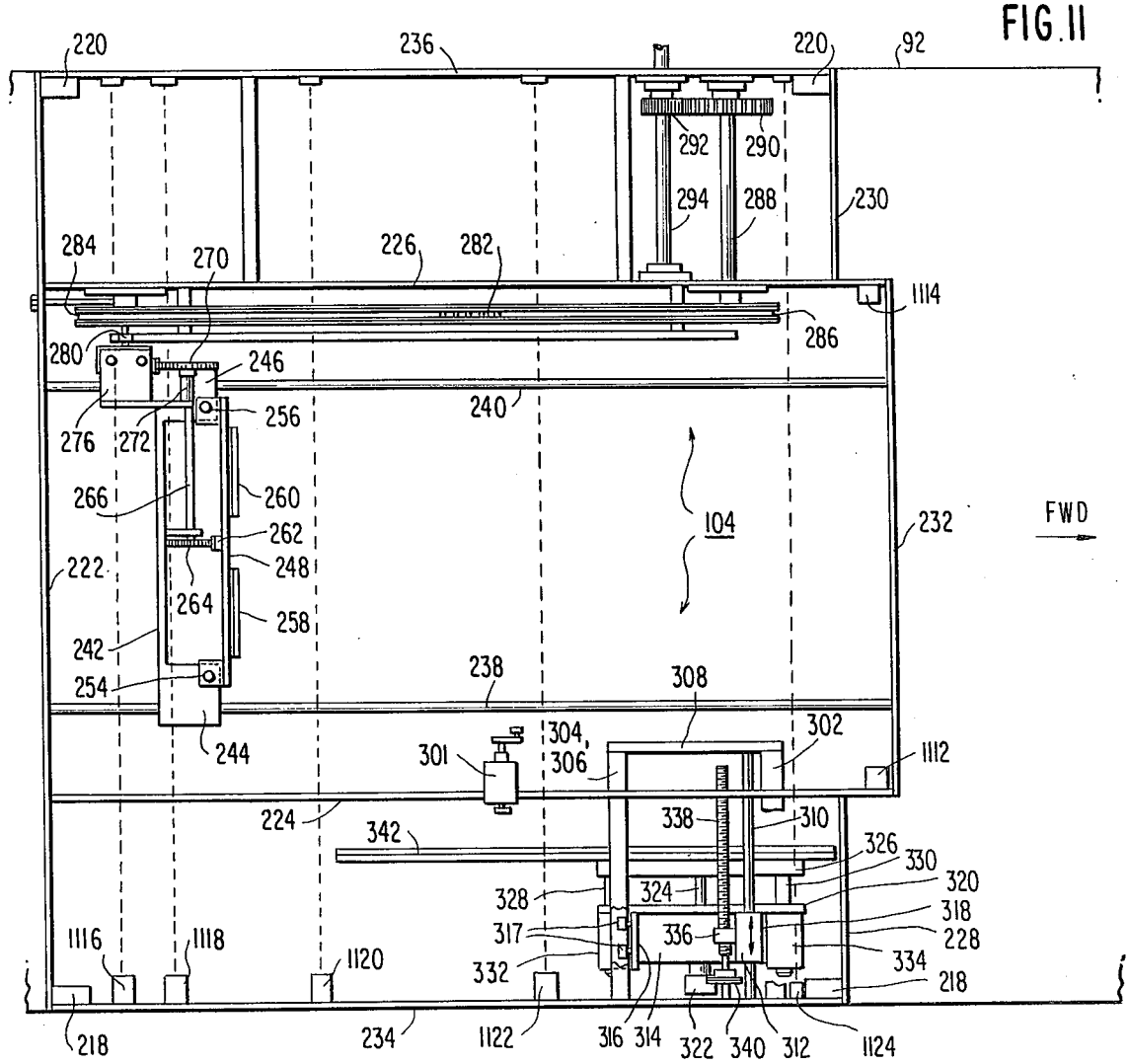

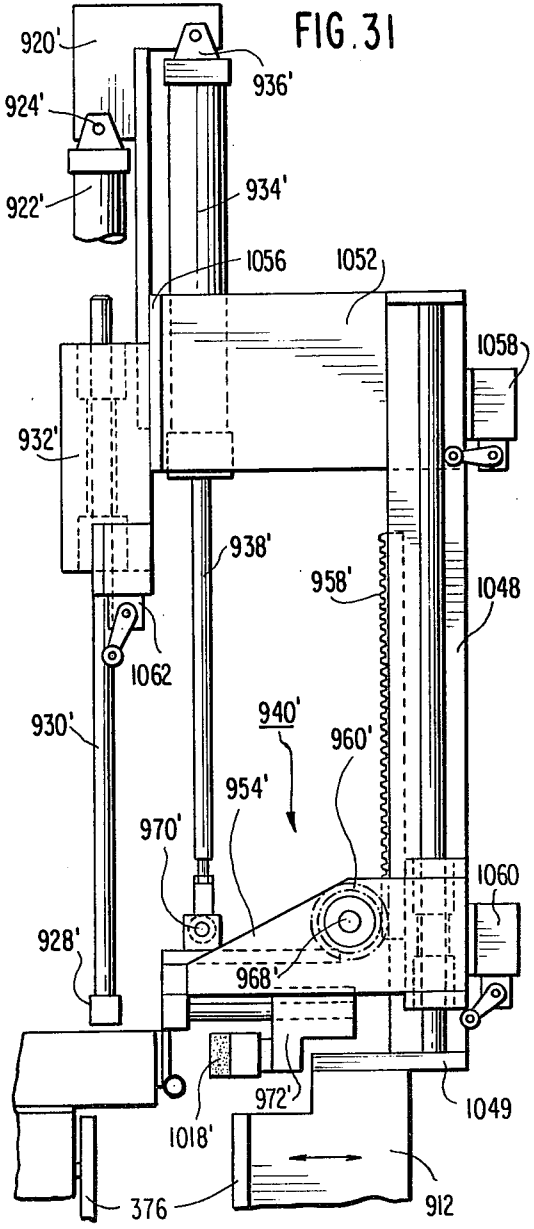
FIG. 31
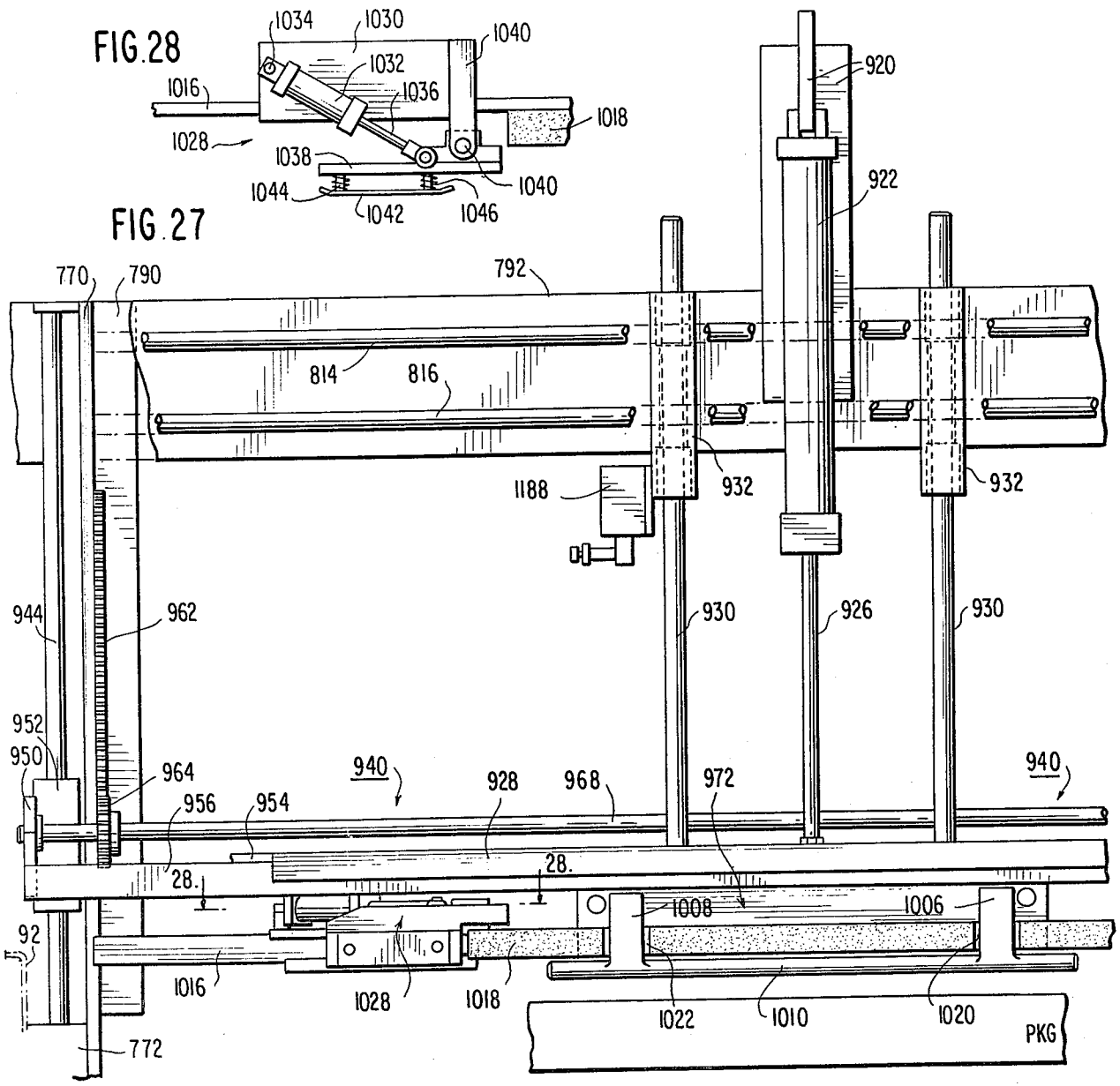
FIG. 28
FIG. 27

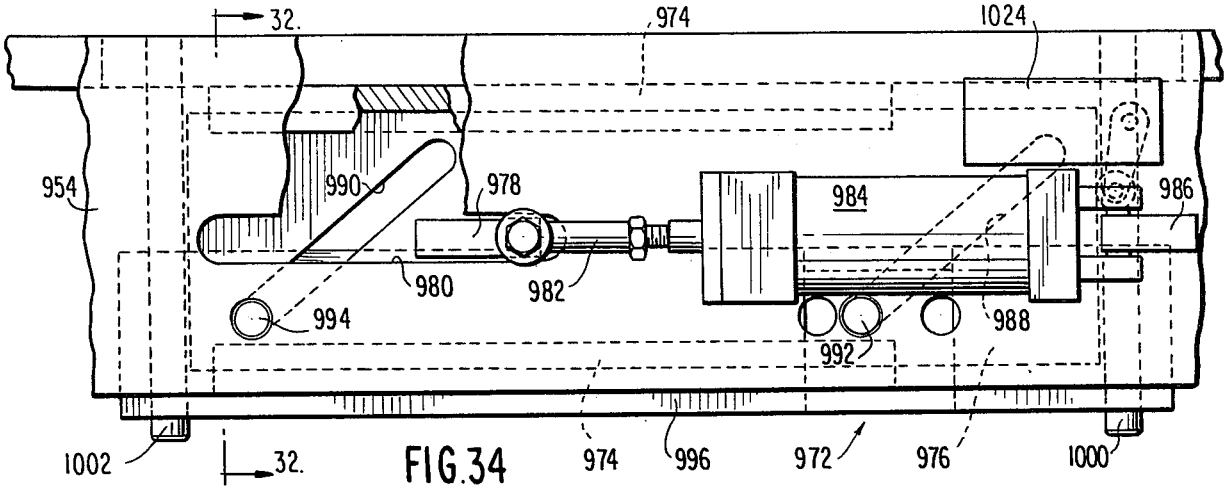
FIG.34
FIG.33
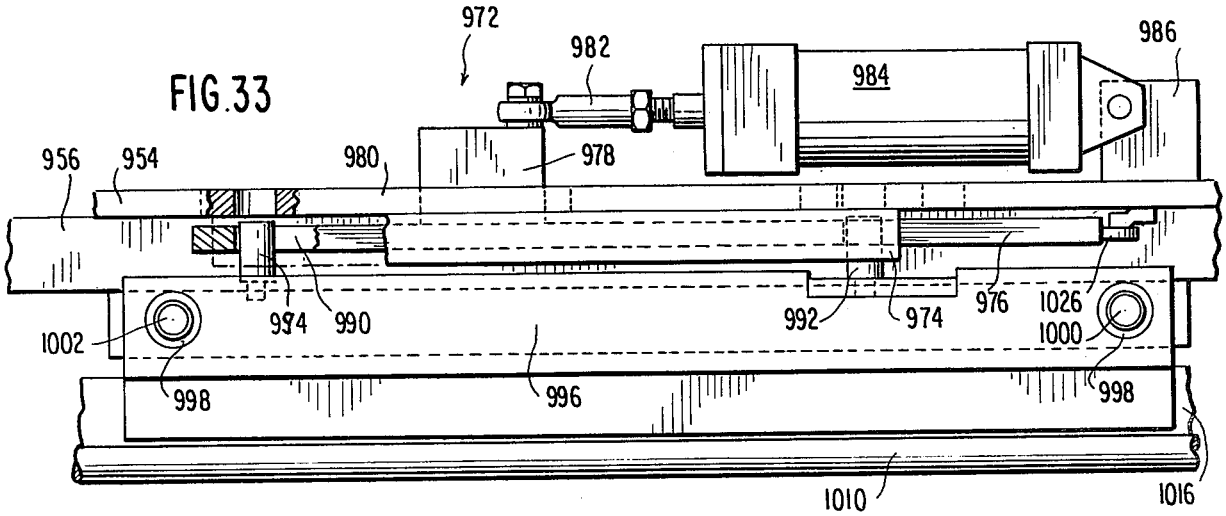
FIG.32
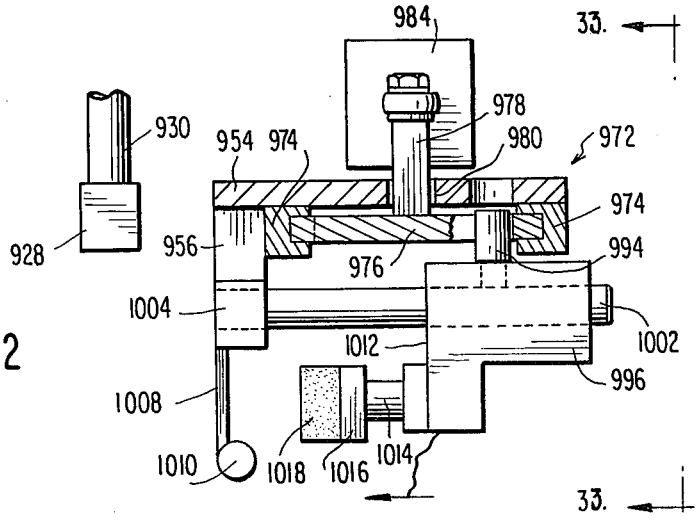

APPARATUS FOR PACKAGING STACKS OF SHEET MATERIAL

DESCRIPTION

1. Technical Field

The present invention relates in general to the art of packaging machines and in particular to machines for packaging stacks of large sheets of material, such as reams of paper.

2. Background Art

The art of designing packages and packaging equipment for various products has developed over the years to the point that automated packaging equipment is available for a seemingly endless variety of products which will accept unwrapped products and package blanks or packaging material and completely package the product for subsequent handling, all without any need for the performance of manual steps by an operator. Some products continue to be wholly or partially manually wrapped, usually where the product is of unusual configuration or where the volume of products produced does not justify the expense of an automated packaging machine.

The paper-making industry is one in which the use of automated handling and packaging equipment has been prevalent for many years. For example, in the manufacture of fine papers such as those used for stationery, copy paper and the like, reams or stacks of paper in typical letter and legal sizes are produced by sheeting equipment and thereafter conveyed, wrapped and boxed entirely automatically. However, when folio-sized sheets of paper are produced, the stacks or reams may range in size from approximately 17 by 24 by 10 inches to 38 by 50 by 3 inches and may weigh upwards of 200 pounds per ream. For these large, heavy reams, the practice in the paper industry has been to package them in cardboard containers typically formed from separate top and bottom blanks which are manually assembled around the product. Since commercially available sheeting equipment can produce folio-sized reams of paper at a rate exceeding the capabilities of a typical manual wrapping station, the continued use of such manual wrapping procedures results in inefficient utilization of modern sheeting equipment and increased labor costs. In spite of this, automated packaging equipment until now has not been developed which will receive folio-sized reams of paper and package them at a rate compatible with today's higher speed sheeting equipment.

Some packaging machines have been developed for other types of products such as those disclosed in U.S. Pat. Nos. 2,215,545 and 2,974,461 issued to R. C. Demler in 1940 and 1961. In these cases, sheets of plywood are manually stacked and placed on a bottom carton blank after which the partially completed package moves along a conveyor where its side flaps are folded and then moves onto a second conveyor extending at a right angle to the initial conveyor where its end flaps are folded. While these types of packaging equipment have achieved a certain degree of success, their large size and requirement for two perpendicular conveyor legs does not suit them for many applications. Thus, a need has continued to exist for a relatively fast, compact packaging machine capable of handling large, heavy stacks of sheet material.

DISCLOSURE OF THE INVENTION

The primary object of the present invention is to provide an improved packaging apparatus for large reams of paper or similarly shaped objects which will rapidly, accurately package the reams without requiring significant intervention by an operator.

Another object of the invention is to provide such an apparatus which is relatively compact and completes the packaging of a ream as the ream moves along an essentially straight path.

Another object of the invention is to provide such an apparatus which can be adjusted transversely to accommodate the delivery paths of various infeed conveyors and which can move reams through the packaging apparatus along a fixed center line or a fixed right-hand edge or a fixed left-hand edge as appropriate.

Another object of the invention is to provide such an apparatus which is readily adjustable to package reams having different lengths, widths and heights.

Another object of the invention is to provide such an apparatus which will automatically package an indefinite series of reams of a given size without requiring operator intervention other than for purposes of refilling hoppers for bottom carton blanks and top carton blanks.

These objects of the invention are given only by way of example; thus, other desirable objectives and advantages inherently achieved by the disclosed structure may occur or become apparent to those skilled in the art. Nonetheless, the scope of the invention is to be limited only by the appended claims.

In the preferred embodiment of the invention, an apparatus is provided for packaging objects of the type having a rectangular parallelepiped configuration with top, bottom, side and end surfaces. A first conveyor receives a series of such objects from a source such as an infeed conveyor and moves them along an essentially straight path. A source of bottom carton blanks is provided for the ultimate package, each of the bottom carton blanks having a plurality of foldable bottom flaps at the edges thereof for use in forming the bottom of the package. The ream or similar object is positioned as it moves along the previously mentioned straight path so that the flaps of the bottom carton blank may be easily folded upward along the side and end surfaces of the ream. After the ream has been so positioned on the bottom carton blank, its movement along the straight path ceases and a top carton blank having a similar plurality of foldable top flaps at the edges thereof is positioned on top of the ream so as to facilitate folding of the top flaps downward to form, in cooperation with the flaps of the bottom carton blank, a package around the object. A plurality of pneumatically actuated folding fingers are provided to fold the side and end flaps of the bottom carton blank while the ream is stopped. The top flaps at the leading and trailing edges of the top carton blank are folded downward by a pneumatically actuated folding mechanism and then the partially packaged ream is moved along the straight path to a second folding station where the end flaps of the top carton blank are folded.

In order to accurately position the bottom carton blank to receive a ream, a stack of blanks is positioned beneath the previously-mentioned straight path and means are provided for positioning a bottom carton blank against stops located at a position beneath the ream as it moves along the path. Additional stops are provided for arresting movement of the ream after its leading edge has moved into the appropriate position above the bottom carton blank, after which the bottom carton blank and ream are moved forward along the path simultaneously.

To position each ream accurately for placement on a bottom carton blank, a support table is provided having an upper surface across which the ream is conveyed. A pusher plate is successively positioned in contact with the trailing edge of each ream and then moved with the ream until the ream encounters the previously mentioned stops. Simultaneously, axially extending vertical guide rails are moved transversely into contact with the ends of the ream in order to square or align its sheets to facilitate subsequent packaging operations.

After the ream has been placed on the bottom carton blank, it moves along the axially straight path on an axially and transversely adjustable conveyor. The mechanisms for folding the bottom flaps at the leading edge of the bottom carton blank are mounted on an axially fixed portion of this conveyor and the mechanisms for folding the bottom flaps at the trailing edge of the bottom carton blank are mounted on an axially movable portion of this conveyor. Similarly, the mechanisms for folding the bottom end flaps of the bottom carton blank are mounted on transversely adjustable portions of this conveyor. Thus, the apparatus may be adjusted to accommodate reams and bottom carton blanks having differing lengths and widths. In a similar fashion, the mechanism for folding the top side flaps at the leading edge of the top carton blank is fixed at a position transverse to the straight path and the mechanism for folding the top flaps at the trailing edge of the top carton blank is axially adjustable simultaneously with the folding mechanisms for the bottom flap at the trailing edge of the bottom carton blank. The mechanisms for folding the end flaps of the top carton blank are mounted for transverse movement in a manner similar to the mechanisms for folding the end flaps of the bottom carton blank.

In operation, the bottom side and end flap folding mechanisms are actuated first to fold the bottom side and end flaps upward adjacent the sides and ends of the ream. Then, after the ream has been compressed to expel entrapped air, the top side flaps are folded downward. To prevent the bottom, side and end flaps from moving away from their upwardly folded positions, the bottom side flap folding mechanisms are retained in their actuated positions and retracted downwardly as the top side flap folding mechanisms move downwardly.

BRIEF DESCRIPTION OF THE DRAWINGS

FIG. 6 is a broken-away elevational view of the infeed end of the packaging apparatus according to the invention, taken from the right side of the apparatus.

FIG. 7 is a fragmentary elevational view of the central, bottom carton folding apparatus according to the invention, taken from the right side of the apparatus.

FIG. 10 is an elevational view of the ream alignment and feed mechanism according to the invention, taken from the right side of the apparatus as seen in the direction of arrows from the line 10—10 in FIG. 3.

FIG. 11 is a top view taken along line 11—11 of FIG. 10.

FIG. 27 is a fragmentary, elevational view of a top carton blank side flap folding mechanism according to the invention, taken along line 27—27 of FIG. 3.

FIG. 28 is a top view taken along line 28—28 of FIG. 27, illustrating the top corner flap folding mechanism according to the invention.

FIG. 31 is a side elevational view of the mechanism illustrated in FIG. 30, taken along lines 31—31 in FIGS. 3 and 30.

FIG. 32 is a side elevational view, partially in section taken along the line 32—32 in FIG. 34, of the top flap compression mechanism illustrated schematically in FIGS. 29 and 31.

FIG. 33 is a view taken along line 33—33 of FIG. 32.

FIG. 34 is a top view of the mechanism illustrated in FIG. 33.

BEST MODE FOR CARRYING OUT THE INVENTION

Figure 2:
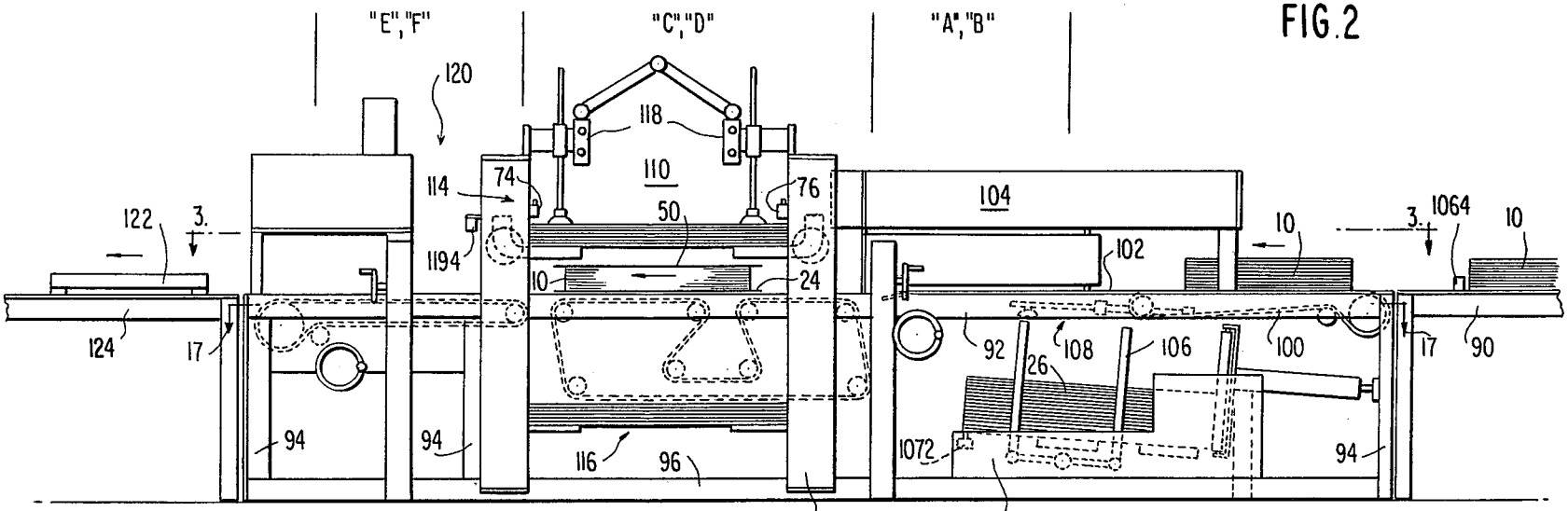
FIG. 2 is an elevational view from the left side of a packaging apparatus according to the present invention.

The following is a detailed description of a preferred embodiment of the invention, reference being made to the drawings in which like reference numerals identify like elements of structure in each of the several Figures.

The Packaging Process

Figure 1:
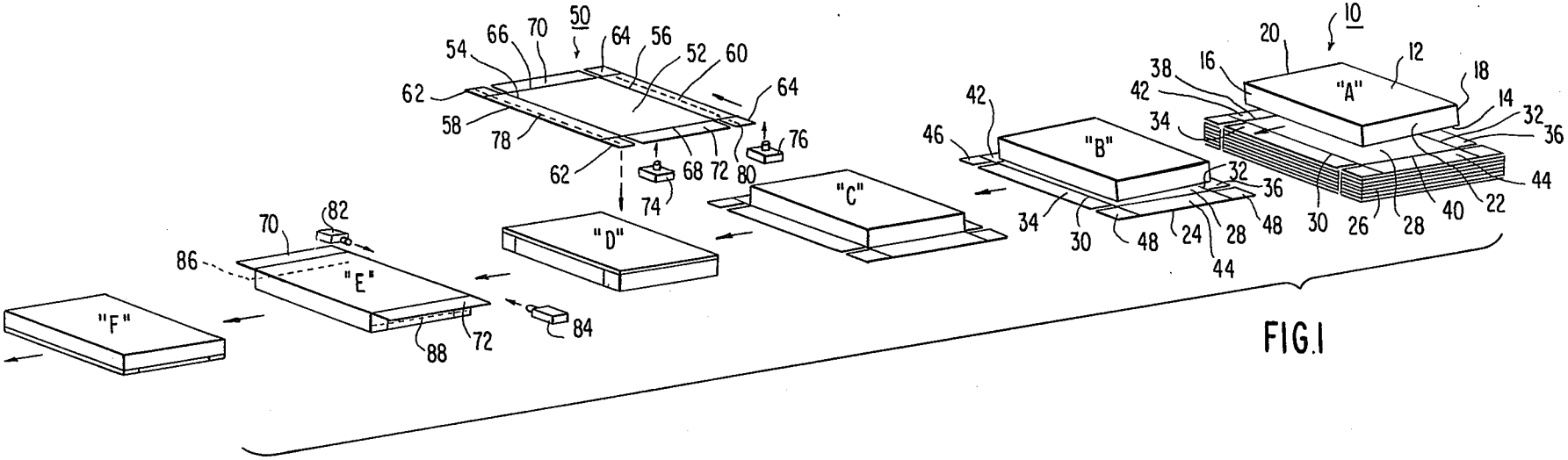
FIG. 1 shows in sequence perspective views "A" to "F" of a folio-sized ream of paper and the bottom and top carton blanks used to package the ream, as the ream and blanks are acted upon by a packaging apparatus according to the present invention.

FIG. 1 shows in sequence the packaging steps performed by an apparatus according to the present invention. As the apparatus operates, a product having an exterior configuration of a rectangular parallelepiped,-such as a folio-sized ream of paper 10,is moved along an essentially straight flow path from position A to position F and during its movement along this path is enclosed within top and bottom carton blanks. The ream 10 or similarly shaped product has a top surface 12, a bottom surface 14, a leading side 16, a trailing side 18, a right end 20 and a left end 22. "Right" and "left" references are established looking down the path from position "A" to position "F". Ream 10 is placed on a bottom carton blank 24 which is automatically removed from a stack 26 of bottom carton blanks. Bottom carton blank 24 includes a rectangular central area 28 which is accurately sized to conform to the shape of bottom surface 14 of ream 10. A pair of side score lines 30, 32 separate central area 28 from a leading bottom side flap 34 and a trailing bottom side flap 36. Similarly, a pair of end score lines 38, 40 separate central area 28 from a bottom right end flap 42 and a bottom left end flap 44. A pair of bottom right end corner flaps 46 (only one of which shows in FIG. 1) and a pair of bottom left end corner flaps 48 extend axially from end flaps 42, 44, respectively.

A bottom carton blank 24 is withdrawn from stack 26 and ream 10 is positioned accurately within central area 28, as illustrated at positions A, B and C. Then, a top carton blank 50, shown at position D, is accurately positioned on top of ream 10 when it has stopped at position D. Top carton blank 50 comprises a rectangular central area 52 which is accurately sized to conform to the shape of top surface 12 of ream 10. A pair of side score lines 54, 56 separate central area 52 from a top leading side flap 58 and a top trailing side flap 60. A pair of top leading side corner flaps 62 and a pair of top trailing side corner flaps 64 extend transversely from side flaps 58, 60 respectively. Similarly, end score lines 66, 68 separate central area 52 from top right end flap 70 and top left end flap 72. As top carton blank 50 is moved from the side into position above ream 10, a leading edge glue gun 74 and a trailing edge glue gun 76 apply glue lines 78, 80 to the undersides of side flaps 58, 60.

After preglued top blank 50 has been positioned on top of ream 10, it is pressed downward near score lines 54, 56 so that air is expelled from the underlying ream, after which the bottom side and end flaps are folded upward adjacent the sides of ream 10 and the bottom corner flaps are folded around, as illustrated at position D. Then, top side flaps 58, 60 are folded downward adjacent upwardly extending bottom side flaps 34, 36, so that preapplied glue lines 78, 80 bond the top side flaps to the bottom side flaps. Simultaneously, the top side corner flaps 62, 64 are folded around into contact with the bottom end flaps.

The partially completed package then moves from position D toward position E with its top end flaps 70, 72 still extending transversely to the path of movement. A right end glue gun 82 and a left end glue gun 84 apply glue lines 86, 88 to the previously folded bottom end flaps and/or top corner flaps. The partially completed package then stops at position E at which top carton blank 50 is pressed downward near score lines 66, 68, following which top end flaps 70, 72 are folded downward against the upwardly extending bottom end flaps and top corner flaps to produce the completed package as shown at position F. Thus, the apparatus according to the invention will package a folio-sized ream of paper within a completely enclosing cardboard container while the ream and its container blanks are moved along an essentially straight path.

Figure 3:
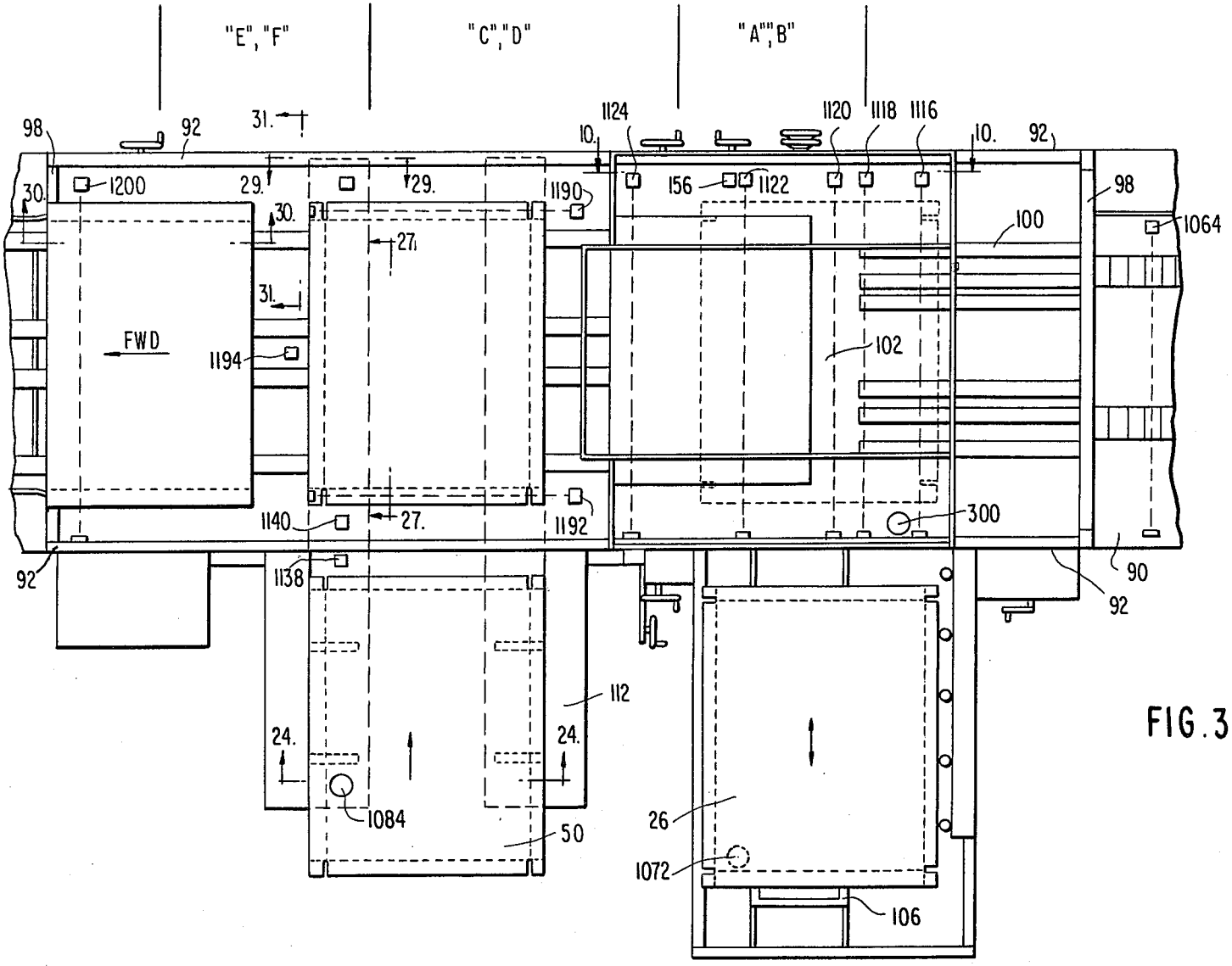
FIG. 3 shows a partial plan view of a packaging apparatus according to the present invention, taken along line 3—3 of FIG. 2.

FIGS. 2 and 3 are side elevational and plan views of a packaging apparatus according to the present invention and illustrate in general the relative positions of the major components of the invention to be described with respect to FIGS. 4–36. The folio-sized reams of paper or similar large parallelepiped shaped objects are received on an infeed conveyor 90 from a source such as a conventional paper sheeter, not shown. The apparatus according to the invention comprises a main frame having parallel horizontal top side rails 92 on its right and left sides, a plurality of vertical side frame members 94 which extend from rails 92 and are joined to a pair of parallel horizontal bottom side rails 96, of which only one is shown in FIG. 2. Extending between the top and bottom side rails are a plurality of horizontal transverse frame members 98. The main frame supports a conventional infeed belt conveyor 100 which receives reams moving from infeed conveyor 90 and places them on the top surface of an infeed air table 102. From table 102, the reams are moved to the left as is illustrated in FIGS. 2 and 3 by a ream feeding and aligning mechanism 104 which positions the reams accurately for subsequent packaging operations and aligns their side edges into the desired parallelepiped configuration. FIG. 2 indicates schematically where the operations are performed at positions A-F shown in FIG. 1.

Extending beneath the main frame of the apparatus is a trolley 106 which supports a stack 26 of bottom carton blanks 24. As bottom carton blanks are needed, trolley 106 moves stack 26 beneath infeed conveyor 100 and onto an elevator mechanism shown schematically in FIGS. 4 and 6. This elevator mechanism raises the stack 26 from trolley 106 toward a lower carton blank feed mechanism 108 shown in FIGS. 2, 4, 5 and 23. Trolley 106 is then retracted and may be refilled with a further stack 26. Feed mechanism 108 removes a single bottom carton blank from the stack supported on the elevator and, in cooperation with ream feeding and aligning mechanism 104, positions the bottom blank 24 beneath ream 10 so that leading side 16 is accurately placed above side score line 30. Thus, as indicated schematically in FIGS. 2 and 3, the functions performed at positions A and B in FIG. 1 are completed.

Once ream 10 has been accurately positioned on bottom carton blank 24, the two are moved onto the indexing conveyor of an initial carton folding and assembly station 110 where they are stopped momentarily. A top carton blank hopper and elevator mechanism 112, though not disclosed in detail in this application, comprises a chain driven elevator mechanism which supports stacks of top carton blanks at an elevated feed station 114 and an underlying hold station 116. A top carton blank feed mechanism 118 is supported by the main frame of the packaging apparatus in position to lift a single top carton blank 50, move it transversely to a position above ream 10 and bottom carton blank 24 previously positioned at folding and assembly station 110, and then accurately position top carton blank 50 on top surface 12 of the ream. After top carton blank 50 has been positioned as illustrated in FIG. 2, the folding operations previously described with regard to positions C and D of FIG. 1 are completed. The partially completed package is then conveyed to a final carton folding station 120 where the top end flaps are folded into position and the operations described with respect to positions E and F of FIG. 1 are completed. The completed package 122 is then delivered to a conventional outfeed conveyor 124 for further processing such as the application of labels.

Feeding a Ream and Bottom Carton Blank

Figures 4, 5:
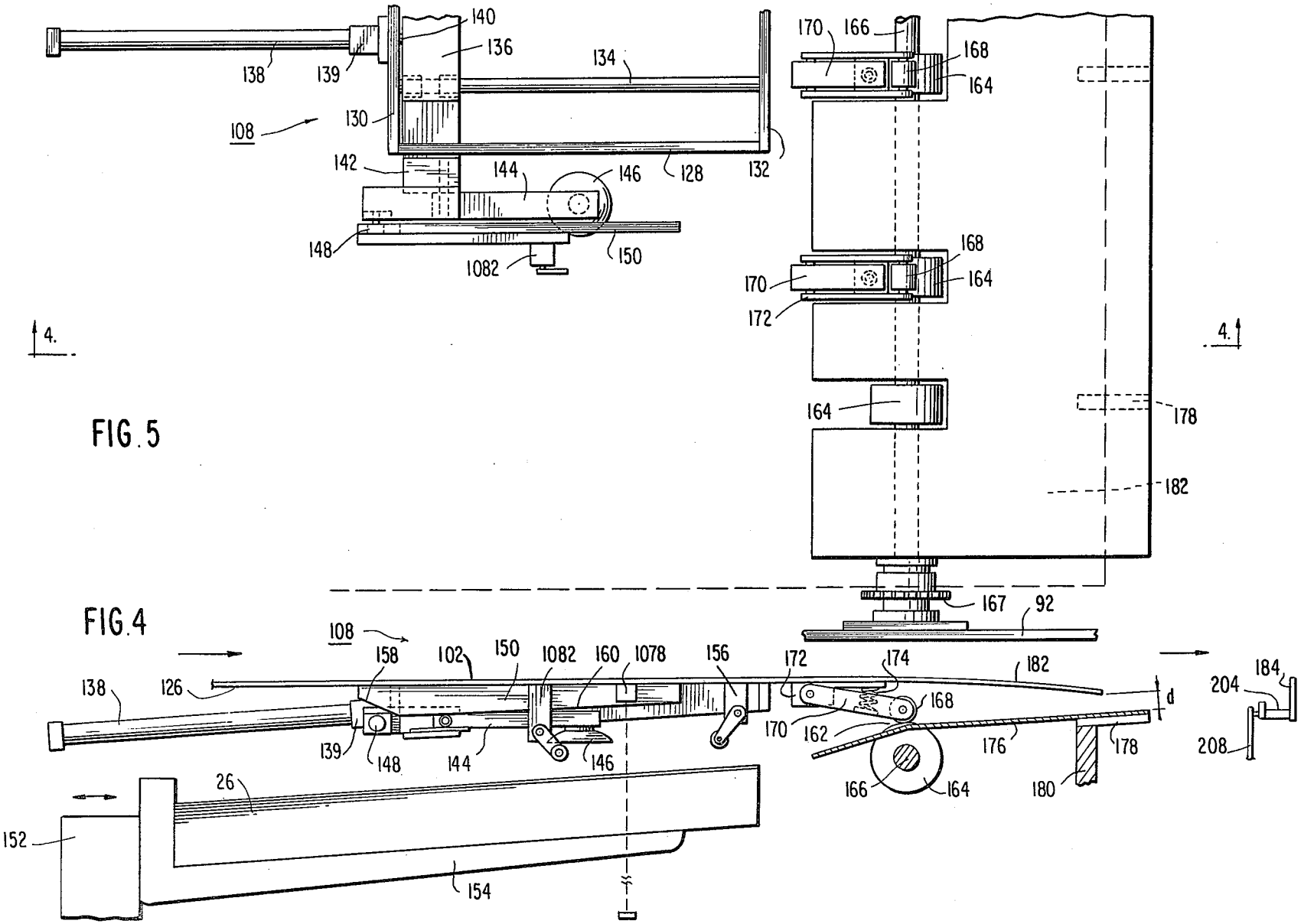
FIG. 4 is a side elevational view of the mechanism according to the invention which removes bottom carton blanks from the cradle of an underlying elevator and delivers them to a position for receiving a ream of paper a portion of the mechanism being shown in a sectional view as seen from the line 4—4 in FIG. 5.
FIG. 5 is a fragmentary top view of the apparatus illustrated in FIG. 4.
Figure 9:
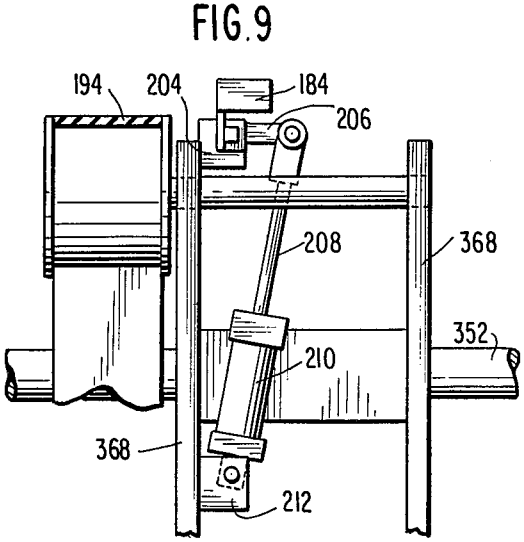
FIG. 9 is an elevational view taken along line 9—9 of FIG. 8, indicating the mechanism which stops bottom carton blanks in position for receiving a ream.

Referring now to FIGS. 4 to 9, the mechanism which feeds bottom carton blanks 24 will be described. In FIGS. 4 and 5, the underside 126 of air table 102 provides a mounting surface for a pair of axially extending mounting plates 128 of which only the right-hand plate is illustrated. Extending between mounting plates 128 are a transverse guide rod and air cylinder support plate 130 and a transverse guide rod support plate 132. A pair of guide rods 134 extend between plates 130, 132 and are angled slightly upward from left to right as viewed in FIG. 4. Mounted on guide rods 134 is a slide block 136. An air cylinder 138 is mounted on the rear surface of support plate 130 and provided with a limit switch 139 which indicates the position of slide block 136 as it is moved by actuator rod 140 of air cylinder 138. On the ends of slide block 136 are mounted pivot blocks 142 to which are attached a pair of vacuum cup arms 144 having at their forward ends a pair of conventional vacuum cups 146. The complete assembly thus far described is shown in phantom in FIG. 23. At the rear ends of vacuum cup arms 144 are provided a pair of transversely extending cam rollers 148 which, in operation, cooperate with the undersides of a pair of vacuum cup cam bars 150 also mounted at the underside 126 of air table 102.

Beneath air table 102, an elevator mechanism 152 such as a ball screw assembly supports an axially extending cradle 154 which receives each stack 26 from trolley 106 and elevates the stack to the position illustrated in FIGS. 4 and 6. As the topmost bottom carton blank comes into contact with vacuum cups 146, it also contacts the actuator arms of limit switches 156 and 1082. In response to actuation of the limit switches, vacuum cups 146 are actuated and adhere to the uppermost bottom carton blank 24 of the stack 26. Thereafter, stack 26 is lowered a short distance by elevator mechanism 152. The weight of bottom carton blank 24 supported by vacuum cups 146 causes cam roller 148 to move into contact with a forwardly and downwardly angled cam surface 158 provided on the underside of cam bar 150. Then, as air cylinder 138 is actuated to push vacuum cup arms 144, vacuum cups 146 and bottom carton blank 24 forward, roller 148 moves down surface 158 causing the leading edge of bottom carton blank 24 to be elevated. As the blank is moved forward, roller 148 eventually leaves cam surface 158 and moves onto a forwardly and upwardly angled cam surface 160 provided on the underside of cam bar 150. Cam surface 160 is parallel to guide rods 134 so that vacuum cups 146 and blank 24 remain in their elevated position as the blank approaches a nip 162 defined between a plurality of carton blank drive rollers 164, mounted for rotation with a shaft 166 driven by a sprocket 167, and a plurality of pinch rollers 168. Rollers 168 are mounted for rotation on arms 170 which are pivotably mounted at the underside of air table 102 by brackets 172. Each pinch roller 168 is biased into engagement with its associated drive roller 164 by means of a spring 174. As bottom carton blank 24 moves between pinch rollers 168 and drive rollers 164, it passes along the upper surface of a carton guide plate 176 which extends across the width of the machine.

The outfeed edge of guide plate 176 includes on its underside a plurality of spacers 178 which position the guide plate relative to an axially fixed portion 180 of the frame of initial carton folding and assembly station 110. See also FIG. 8. As shown in FIG. 4, the discharge apron 182 of air table 102 is spaced a short distance "d" above guide plate 176 to define an opening or slot which extends transverse to the path of the ream and permits bottom carton blank 24 to move freely forward under the influence of rollers 164, 168. Forward movement of bottom carton blank 24 is arrested by a pair of transversely spaced stop fingers 184 which are moved upward into the path of the bottom carton blank by a mechanism shown in FIGS. 7–9.

The initial carton folding and assembly station 110 comprises an axially and transversely adjustable index conveyor 186, as shown in FIGS. 6–8 and 16–22. Conveyor 186 includes an axially and transversely adjustable right-hand belt 188, a pair of axially adjustable central belts 190, 192 and an axially and transversely adjustable left-hand belt 194. Central belts 190, 192 are supported on rollers mounted for rotation on a central, fixed support member 196; whereas, belts 188 and 194 are mounted on transversely adjustable supports 198, 200. Mounted within each of supports 198, 200 is pivot block 202 which rotatably supports a square shaft 204 on which stop finger 184 is positioned. By means of a set screw or the like, the position of stop finger 184 on shaft 204 may be adjusted to accurately position the leading edge of bottom carton blank 24 so that score line 30 is aligned with leading side 16 of ream 10. An arm 206 extends radially from shaft 204 and is pivotably connected to the actuator shaft 208 of an air cylinder 210 which, in turn, is pivotably supported by a bracket 212 attached to the adjacent support 198, 200. Thus, when air cylinder 210 is actuated, stop fingers 184 are rotated upwardly into the path of movement of bottom carton blank 24. Once bottom carton blank 24 has been properly positioned against stop fingers 184, ream feeding and aligning mechanism 104 proceeds to position the ream with its leading side 16 aligned with score line 30.

The internal structure of mechanism 104 will be described with regard to FIGS. 6 and 10–15. Among other things, FIG. 6 illustrates a conventional air blower 214 and associated ducting 216 which direct air to a manifold (not illustrated) located beneath air table 102. Air flow is directed through the upper surface of table 102 via a plurality of orifices in the conventional manner so that heavy reams of folio-sized paper can be moved relatively easily along the surface of table 102. After ream 10 leaves infeed conveyor 100, its movement through the apparatus is controlled by the mechanism illustrated in FIGS. 10–14. A pair of right-hand support posts 218 and a pair of left-hand support posts 220 are connected near their upper ends by a transverse infeed tie plate 222. Extending axially from plate 222 are right and left interior wall plates 224, 226 which are joined at the discharge end of mechanism 104 by center discharge tie plate 232. Right- and left-hand discharge tie plates 228, 230 extend laterally from wall plates 224, 226 and are joined to right-hand left-hand side plates 234, 236 which extend between infeed tie plate 222 and the outboard edges of discharge tie plates 228, 230. Thus, a rigid support structure is provided for ream feeding and aligning mechanism 104.

Within the support structure defined by the previously described tie plates, right and left guide rods 238, 240 extend axially from tie plate 222 to tie plate 232 parallel to the path of movement through the apparatus. A transversely extending support carriage 242 is mounted for axial movement on guide rods 238, 240 by means of right and left axial extensions 244, 246 of carriage 242. A rigid, vertically extending pusher plate 248 is mounted for upward and downward movement relative to carriage 242 by means of a pair of parallel vertical guide rods 250, 252 which are mounted on the back of plate 248 by suitable brackets. Guide rods 250, 252 slide in ball bushings located in bores 254, 256 provided in extensions 244, 246 of carriage 242. A pair of upwardly tapering ream alignment wedges 258, 260 are mounted on the front side of pusher plate 248 for the purpose of intentionally misaligning a ream of paper so that its leading and trailing edges are slanted toward the infeed end of the machine. The use of wedges 258, 260 has been found desirable in some applications where the papers of the ream tend to shift toward the discharge side when the ream moves from air table 102 onto bottom carton blank 24. By misaligning the ream in this fashion, it tends to square itself automatically, thus maintaining the desired rectangular parallelepiped configuration.

On the infeed side of pusher plate 248, a vertically extending gear rack 262 is provided which meshes with a spur gear 264 mounted for rotation with a shaft 266 which is supported for rotation by carriage 242. At the outer end of shaft 266, a spur gear 268 is mounted for rotation with the shaft, this gear being engaged with a further spur gear 270 which is mounted for rotation on carriage 242 via a stub shaft 272. A pair of parallel, vertical guide rods 274 are supported by carriage 242 and a drive carriage 276 is mounted on guide rods 274 by suitable ball bushings. A gear rack 278 mounted on the forward end of drive carriage 276 meshes with spur gear 270 so that as drive carriage 276 moves on guide rods 274, pusher plate 248 is moved on guide rods 250, 252. A roller connector 280 is mounted on drive carriage 276 and includes an axially extending pin (not shown) which engages an endless pusher plate drive chain 282. A driven sprocket 284 and a drive sprocket 286 support chain 282 in such a way that the portions of chain 282 extending between the sprockets are essentially parallel to the upper surface of table 102. Drive sprocket 286 is mounted for rotation with a shaft 288 driven by a spur gear 290 mated with a further spur gear 292 mounted for rotation with a shaft 294. A timing belt 296 passes over a timing belt pulley 298 mounted for rotation with shaft 294 so that chain 282 is driven over its sprockets. The source of power for timing belt 296 will be discussed subsequently with regard to FIG. 23.

Figures 12, 13, 14, 15:
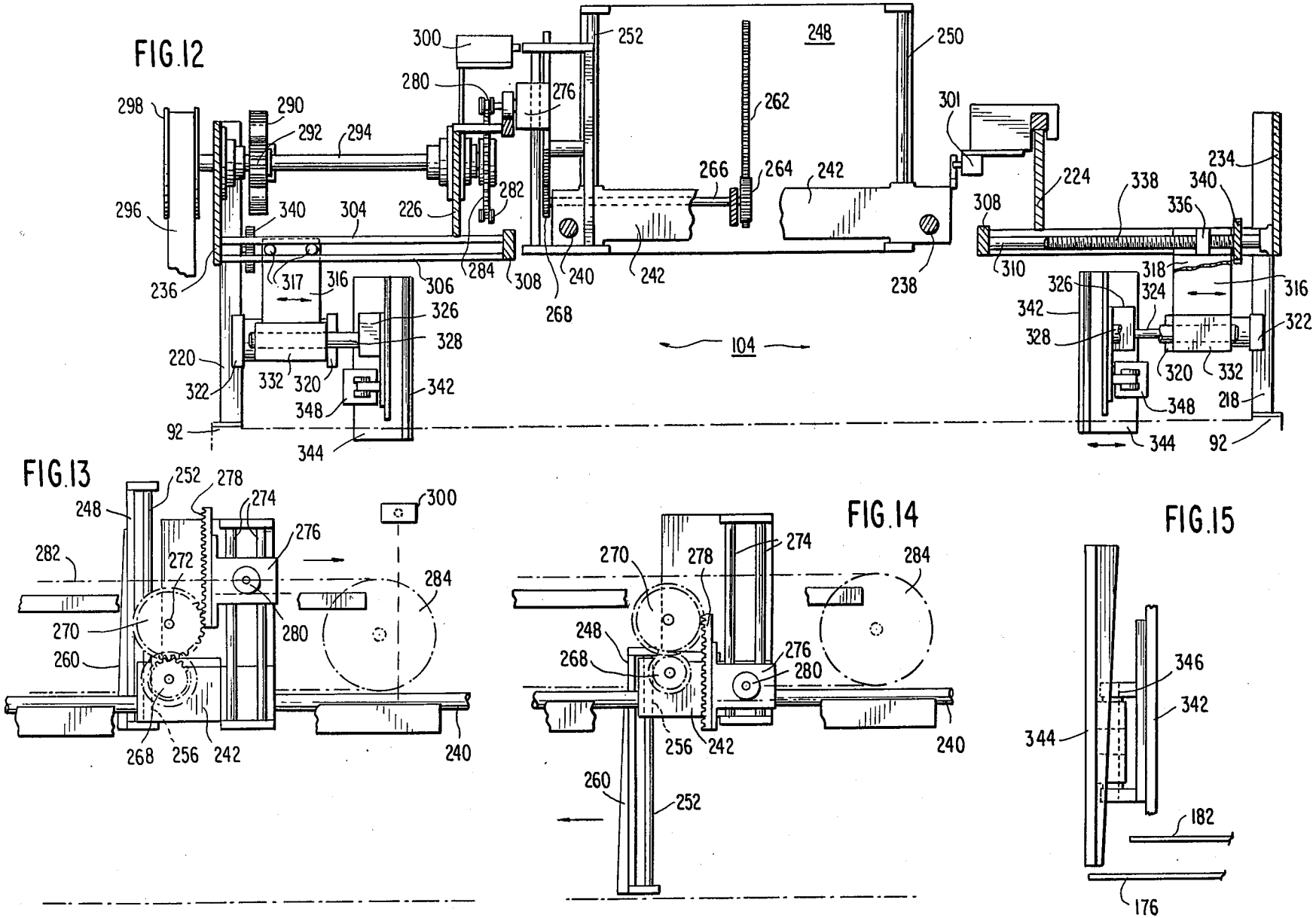
FIG. 12 is an end view taken along line 12—12 of FIG. 10.
FIGS. 13 and 14 show sequential positions of the apparatus illustrated in FIGS. 10—12.
FIG. 15 is a detail view taken along line 15—15 of FIG. 10, illustrating one of the stop plates which hold a ream in position above the underlying bottom carton blank.

Referring to FIGS. 13 and 14, the operation of the pusher plate drive mechanism may be clearly understood. As drive chain 282 is rotated in the clockwise direction as viewed in FIG. 13, roller connector 280 will move on an essentially level path along the uppermost segment of chain 282, drawing the pusher plate assembly toward the infeed end of the apparatus. However, as roller connector 280 follows chain 282 around driven sprocket 284, it causes drive carriage 276 to move downward on guide rods 274, thereby moving gear rack 278 downward which causes spur gears 270, 268 and 264 to rotate, thereby causing pusher plate 248 to move downward to the position illustrated in FIG. 14, just behind ream 10 where the latter stops after leaving conveyor 100. Of course, when the mechanism reaches the discharge end of chain 282 and roller connector 280 begins to move upward around drive sprocket 286, then pusher plate 248 will be drawn upward to the position illustrated in FIG. 13. To provide an indication that pusher plate 248 is elevated and in position to drop behind a ream just received on table 102 from conveyor 100, a proximity switch 300 preferably is mounted as shown in FIGS. 12 and 13 for actuation by the presence of the upper portion of guide rods 274 and their associated support bracket structure. To provide an indication that pusher plate 248 has moved a ream into position with leading side 16 above score line 30, an axially adjustable limit switch 301, actuated by contact with carriage 242, is positioned on wall plate 224 as shown in FIGS. 11 and 12.

In many instances, reams received from the infeed conveyor will not be properly positioned relative to the longitudinal axis of the apparatus or will not be properly squared or aligned for packaging. In view of this, means are provided for shifting reams transversely on air table 102 so that the ream is squared along ends 20, 22 and is properly positioned for subsequent placement upon a bottom carton blank. The mechanism for achieving this alignment and movement of the ream is shown in FIGS. 10, 11, 12 and 15. These Figures specifically illustrate the mechanism which is located on the right side of the apparatus; however, it should be understood that an opposite hand mechanism is located on the left side as well. A transversely extending horizontal support bar 302 is supported between interior wall plate 224 and right side plate 234 at a location near the discharge end of the feed mechanism. Spaced from bar 302 in the direction of the infeed end of the mechanism are a pair of vertically spaced transversely extending guide tracks 304, 306 also supported between wall plate 224 and side plate 234. The inner ends of the bar 302 and tracks 304, 306 are joined by an axially extending, horizontal guide rail support bar 308. A transversely extending, horizontal guide rod 310 is mounted between support bar 308 and side plate 234 and a bearing block 312 is slidably mounted thereon. A tie plate 314 supports bearing block 312 and extends between a pair of axially spaced, vertical support plates 316, 318. The upper end of plate 316 supports a pair of rollers 317 which ride between guide tracks 304, 306 and provide support for plate 316. A mounting bar 320 is attached to the lower, inner edges of plates 316, 318 to provide support for a transverse air cylinder 322 which extends outwardly from bar 320. The actuator shaft 324 of cylinder 322 extends through bar 320 and is attached to an axially extending guide rail support bar 326. At the opposite ends of support bar 326 are attached a pair of mounting rods 328, 330 which are slidably supported at their opposite ends by a pair of bearing blocks 332, 334 mounted on the lower side surfaces of support plates 316, 318. A screw nut 336 attached to bearing block 312 is in threaded engagement with a lead screw 338 which extends from a suitable flange bearing on side plate 234 and in use is rotated by a sprocket 340. The source of power to drive sprocket 340 will be discussed subsequently with regard to FIGS. 16–18.

Mounted on and extending upwardly from support bars 326 are a pair of side guide rails 342 which extend axially along table 102 for a distance approximately equalling the maximum anticipated width of a ream to be packaged. At the discharge ends of guide rails 342, a pair of stop plates 344 are mounted via hinges 346. As indicated in FIG. 15, the lower edges of stop plates 344 is positioned at a level between the discharge edges of lower carton blank guide plate 176 and ream discharge apron 182, but to the rear of stop fingers 184. Stop plates 344 are rotated into the path of a ream being pushed along table 102 by pusher plate 248, by means of an air cylinder 348 mounted on the outer surface of guide rail 342 and connected to stop plate 344 by a suitable actuator rod 350. In operation, as a ream is moved along the upper surface of air table 102 by pusher plate 248, the guide rails 342 are moved inward by air cylinders 322 in order to align the sides of the ream and properly position it for subsequent placement on its bottom carton blank. When reams of different sizes are to be packaged, the positions of guide rails 342 may be adjusted by rotating lead screws 338, as will be discussed subsequently. When stop plates 344 are contacted by a ream and stop fingers 184 are contacted by a bottom carton blank, then leading side 16 is aligned with score line 30; end surfaces 20, 22 are aligned with score lines 38, 40; and trailing side 18 is aligned with score line 32. Thus, the ream is positioned relative to the bottom blank to facilitate upward folding of side flaps 34, 36 and end flaps 42, 44.

Folding the Flaps of a Bottom Carton Blank

Figure 8:
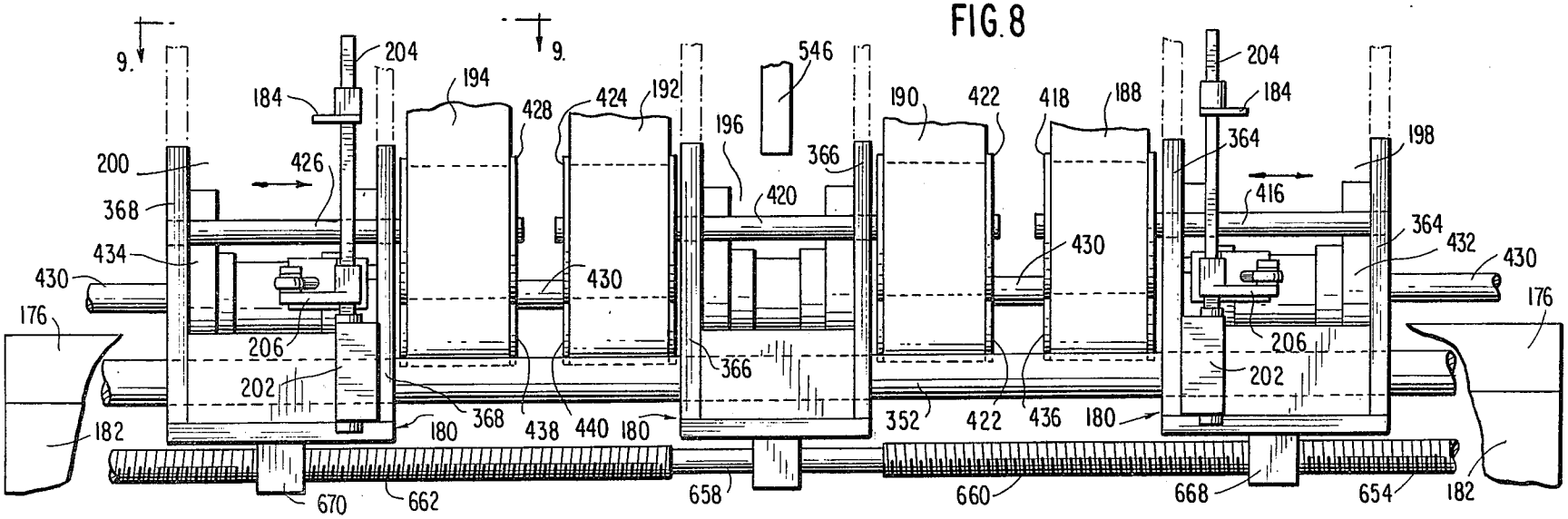
FIG. 8 is a fragmentary top view taken along line 8—8 of FIG. 7 or 16.
Figures 16, 17, 18:
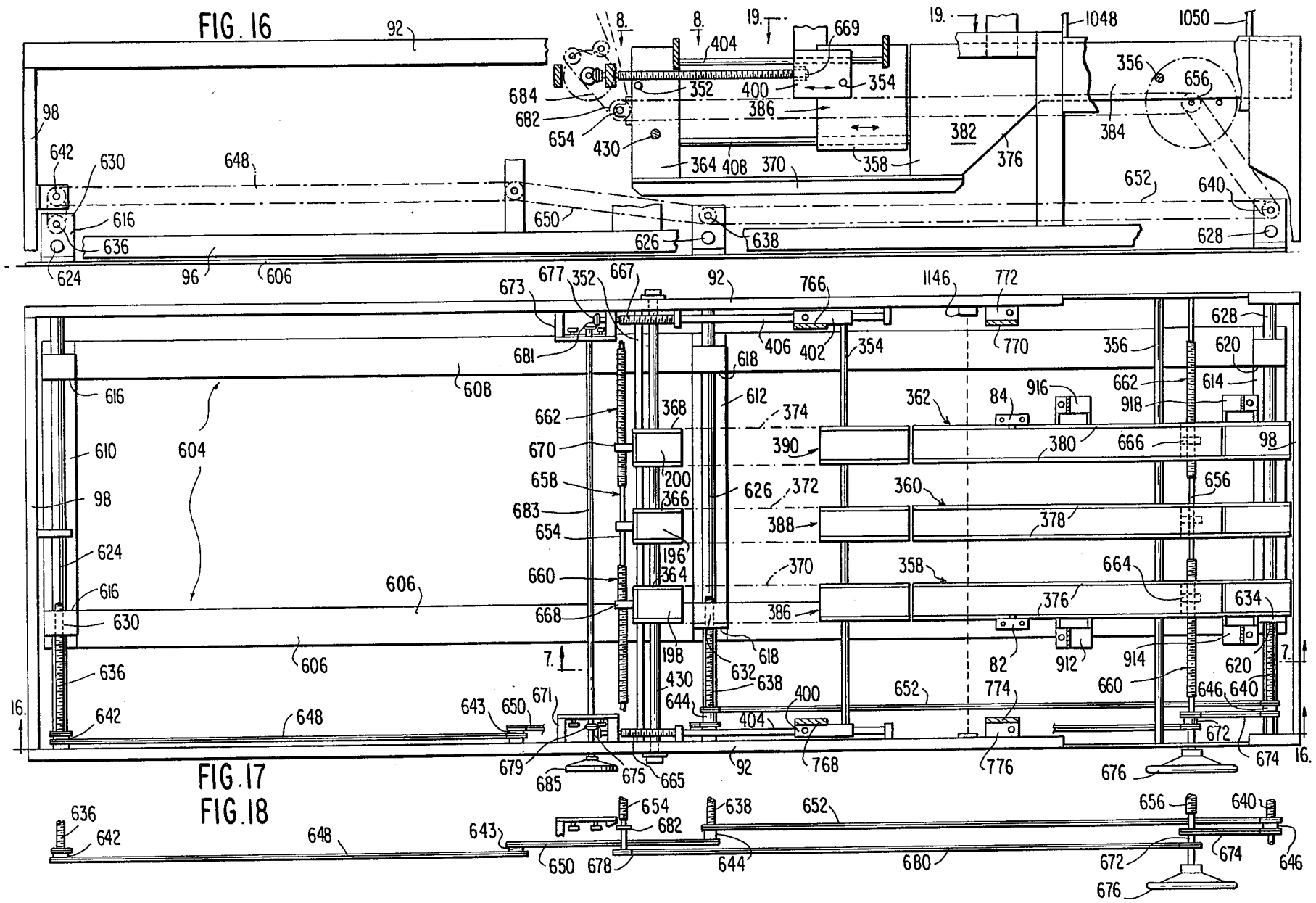
FIG. 16 is a right side elevational view and FIGS. 17 and 18 are top views of the components of the invention which permit adjustment to accommodate reams having differing widths and lengths FIG. 17 being a view as seen in the direction of arrows from the line 17-17 in FIG. 2.

FIGS. 6–8 and 16–22 illustrate both the index conveyor 186 which moves the ream and bottom blank through the apparatus and the mechanis,ms which fold the bottom side and end flaps. FIG. 17 is a view into the interior of the apparatus, taken along line 17—17 of FIG. 2 but from the opposite side. A fixed infeed lateral guide rod 352, an axially movable lateral guide rod 354 and a fixed discharge lateral guide rod 356 are shown mounted between the opposite top side rails 92 of the main frame of the apparatus. Mounted on these guide rods for movement transverse to the main frame are a right-hand, laterally adjustable conveyor support frame 358, a central fixed conveyor support frame 360 and a lefthand laterally adjustable conveyor support frame 362. The infeed ends of these conveyor support frames are defined, respectively, by spaced pairs of vertical side plates 364, 366, 368 as shown in FIGS. 8, 16 and 17. From the lower ends of these side plates, axial tie rails 370, 372, 374 extend forward and are attached to pairs of vertically extending frame plates 376, 378 and 380 as shown in FIGS. 7, 16, 17 and 19. Each of the frame plates in pairs 376, 378, 380 comprises an upwardly extending trapezoidal portion 382 (FIG. 16) integral with an elongated rectangular portion 384 which extends axially to the end of the machine. Although the interconnections are not specifically illustrated, it will be understood that the various side plates, tie rails and frame plates making up conveyor support frames 356–360 are interconnected transversely so as to form rigid beam-like structures. Each of conveyor support frames 358–362 is provided with an axially movable carriage portion 386, 388, 390, respectively. Each carriage portion comprises a pair of vertically extending side plates 392, 394, 396 as shown best in FIGS. 19 and 20. Axially movable lateral guide rod 354 extends through each of side plates 392, 394, 396 and is supported at its ends by a pair of axially movable adjustment blocks 400, 402. A pair of axially extending support bars 404, 406 are mounted on the inside of the upper side rails 92 of the main frame in position to support adjustment blocks 400, 402 by means of suitable ball bushings. The conveyor carriages 386–390 are supported at their lower ends on axially extending support shafts 408, 410, 412 which extend through suitable ball bushings provided at the lower ends of carriages 386–390. Support shafts 408 412 are fixedly mounted at their opposite ends by means of flanges 414 provided on side plates 364–368 and frame plates 376–380 (FIG. 7).

As shown in FIGS. 7, 8, 19 and 20, conveyor belts 188–194 are supported for movement by a system of timing belt rollers which are mounted for rotation next to side plates 364–368, frame plates 376–380 and side plates 392–396. At the infeed side plates 364, a shaft 416 extends between plates 364 and supports a timing belt roller 418 over which belt 188 passes. At infeed side plates 366, a shaft 420 extends through the outer sides of side plates 366 and supports a pair of timing belt rollers 422, 424 over which belts 190, 192 run. At infeed side plates 368, a shaft 426 supports a timing belt roller 428 over which belt 194 is run. As shown in FIG. 7 and in greater detail in FIG. 8, a conveyor drive shaft 430 extends beneath roller shafts 416, 420 and 426 and is supported for rotation by right and left flange bearings 432 and 434 mounted on side plates 364, 368. Drive shaft 430 includes splined or keyed portions, not illustrated, on which a right-hand drive roller 436 and a left-hand drive roller 438 are mounted for rotation with and transverse movement on shaft 430 and a central portion on which a pair of central drive rollers 440, 442 are fixedly mounted for rotation with the shaft, as shown in the lower portion of FIG. 8.

Figure 19:
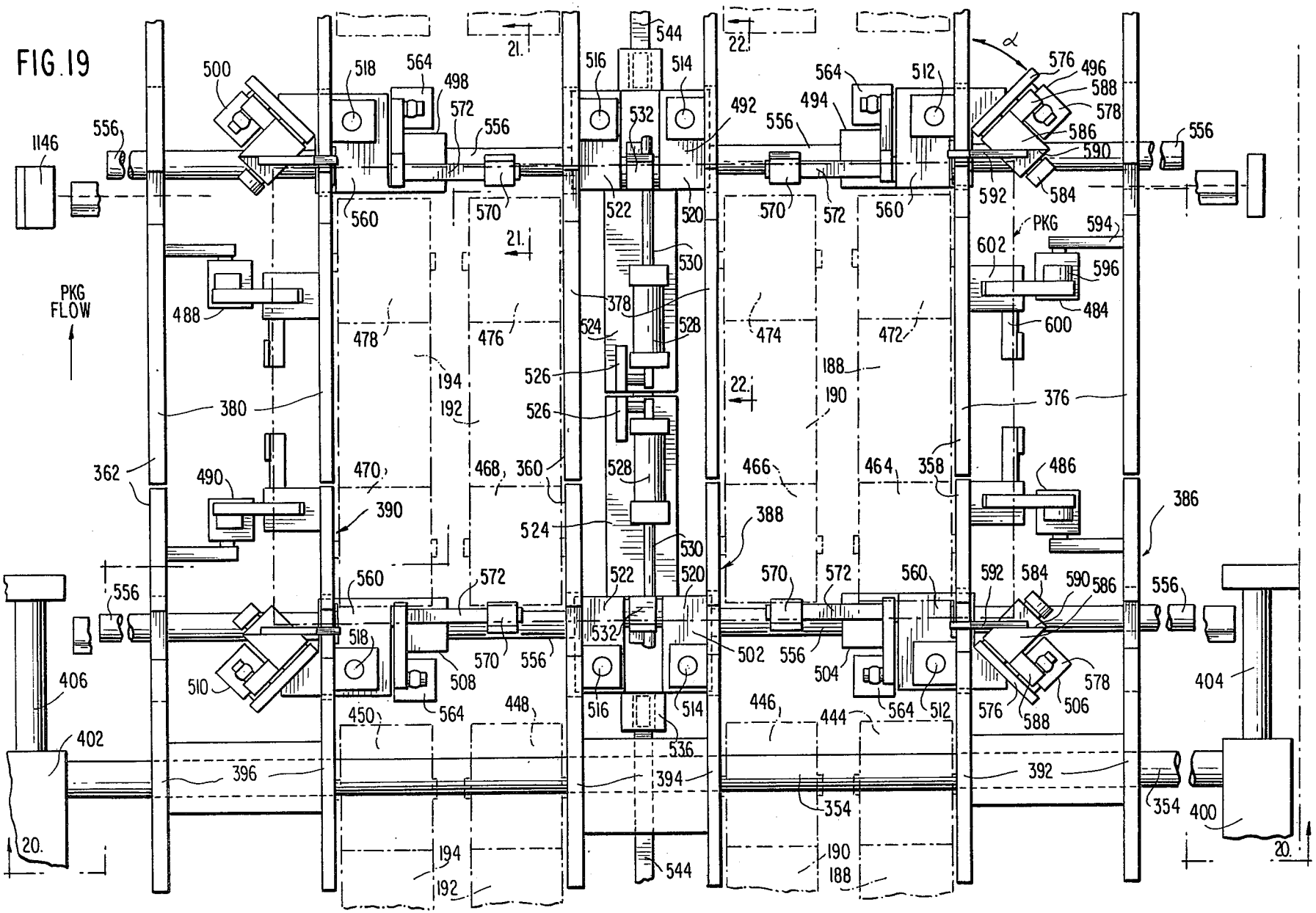
FIG. 19 is a plan view taken along line 19—19 of FIG. 16, illustrating the mechanisms for folding the side and end flaps of the bottom carton blank.

At carriages 386–390, belts 188–194 pass over a set of rollers 444–450 as shown in phantom in FIGS. 7 and 19. From rollers 444–450, the belts travel downward and around the infeed side of a set of rollers 452–458 mounted on shafts 459, and then travel across the lower portions of carriages 386–390 and around a corresponding set of rollers 460 similarly mounted on a set of shafts 462 as indicated in phantom in FIG. 7. Then, belts 188–194 are led upward and over the infeed sides of a set of rollers 464–470 as illustrated in phantom in FIG. 19. The belts then cross the gap between carriages 386–390 and pass over a set of rollers 472–478 mounted for rotation on frame plates 376–380 as illustrated in phantom in FIG. 19. The belts then drop downward to a further set of rollers 480, mounted on a set of shafts 482 (FIGS. 7, 20) before returning to drive rollers 436–442. Thus, while belts 188–194 are moving due to rotation of shaft 430, ream 10 and bottom carton blank 24 deposited thereon will travel from the position at stop fingers 184 and stop plates 344 to the right until they reach the appropriate position for placement of top carton blank 50 on top surface 12 of ream 10. The flap folding operations previously described with respect to FIG. 1 then begin.

The end and side flaps 42, 44 and 34, 36 of bottom carton blank 24 are folded upward using the mechanisms shown in FIGS. 19–22. Referring to FIG. 19, it will be seen that on the right side bottom end flap folding mechanisms 484, 486 are mounted, respectively, between frame plates 376 and carriage side plates 392. On the left side of the machine, bottom end flap folding mechanisms 488, 490 are mounted, respectively, between frame plates 380 and carriage side plates 396. The leading bottom side flap 34 and the adjacent corner flaps 46, 48 are folded into position adjacent the leading side 16 of the ream 10 by a central side flap folding mechanism 492, a pair of outer side flap folding mechanisms 494, 498 and a pair of corner flap folding mechanisms 496, 500 as shown at the upper portion of FIG. 19. Similarly, the trailing bottom side flap 36 and the adjacent corner flaps 46, 48 are folded by a central side flap folding mechanism 502, a pair of outer side flap folding mechanisms 504, 508 and a pair of corner flap folding mechanisms 506, 510 as shown at the lower portion of FIG. 19.

Except for end flap folding mechanisms 484–490, the folding mechanisms for the flaps of bottom carton blank 24 are mounted for vertical movement relative to the main frame of the machine so that they may be removed from the path of packages as they move through the apparatus and from the paths of top side flaps 58, 60 as they move downward during folding. Thus, outer side flap folding mechanisms 494, 504 and corner flap folding mechanisms 496, 506 are mounted for movement on a pair of vertical lift rods 512 attached, respectively, to frame plate 376 and side plate 392. Central side flap folding mechanisms 492, 502 are mounted for vertical movement on pairs of vertical lift rods 514, 516 suitably attached between frame plates 378 and side plates 394. Finally, outer side flap folding mechanisms 498, 508 and corner flap mechanisms 500, 510 are mounted on a pair of vertical lift rods 518 suitably attached, respectively, to frame plate 380 and side plate 396.

Figure 22:
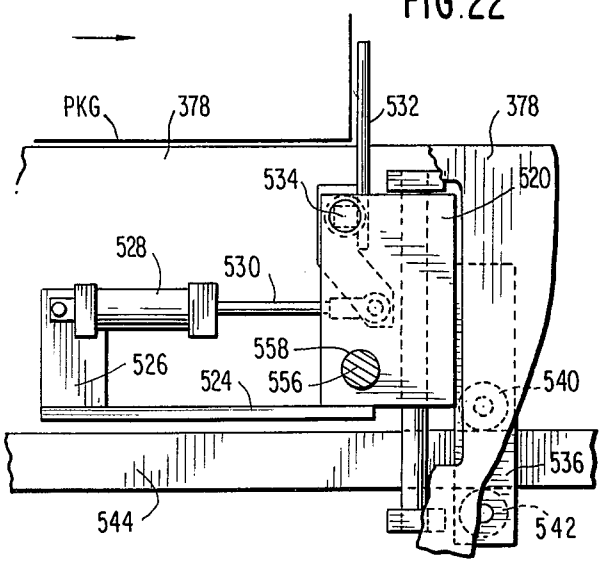
Figure 20:
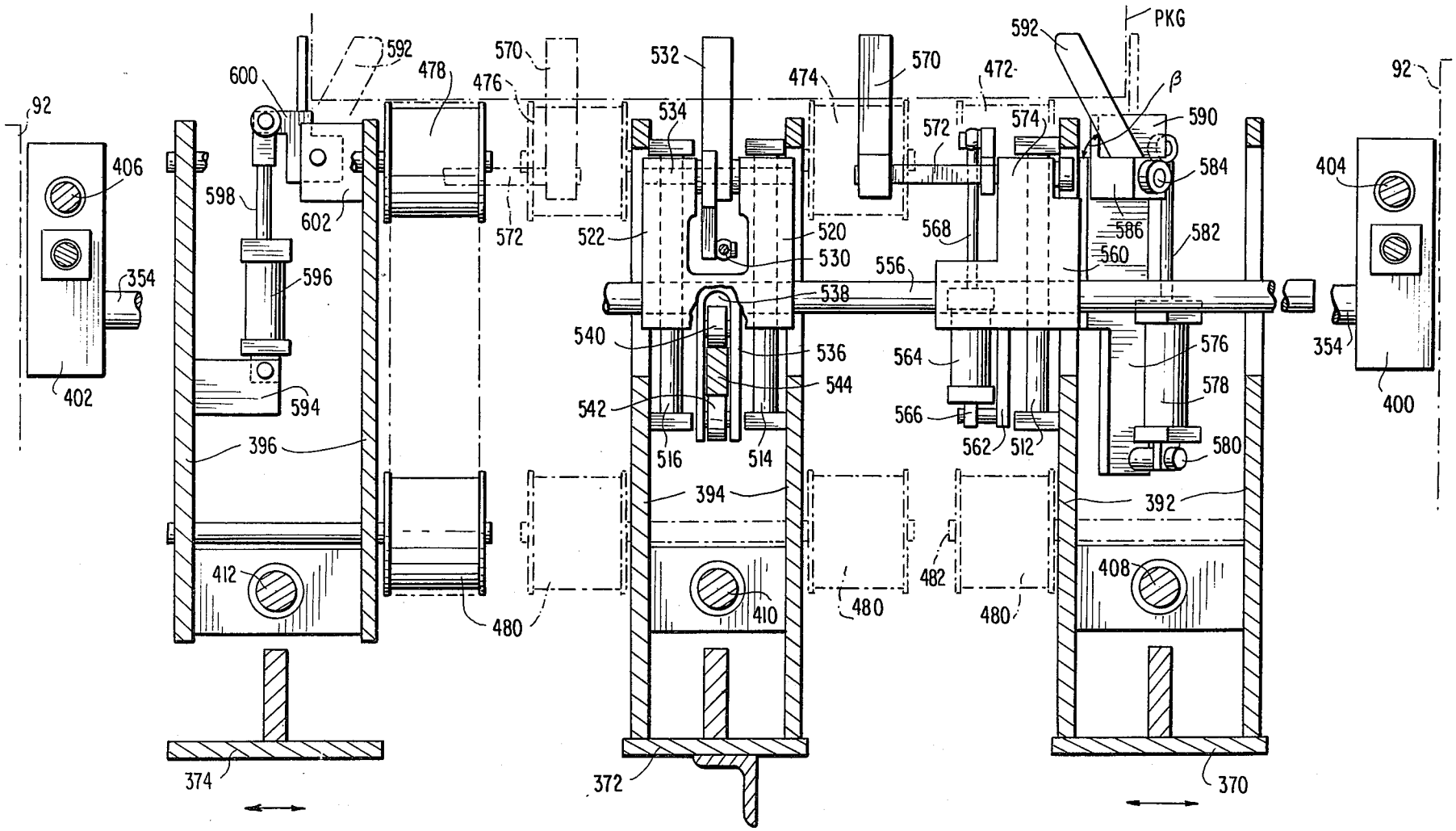
FIG. 20 is an elevational view taken along staggered section line 20—20 of FIG. 19, illustrating additional details of the flap folders and bottom size adjustment features according to the present invention.

As shown in FIGS. 19, 20 and 22, central side flap folding mechanisms 492, 502 each comprise a pair of lift blocks 520, 522 which are mounted for vertical movement via suitable ball bushings on lift rods 514, 516. A cylinder support plate 524 is attached to the undersides of lift blocks 520, 522 and includes an upwardly extending cylinder bracket 526. The actuator rod 530 of air cylinder 528 is pivoted to a central folding finger 532 mounted between lift blocks 520, 522 on a suitable pivot 534. Finger 532 preferably has a flat face for engaging the side flap. A further lift block 536 is attached to the outside surfaces of lift blocks 520, 522 and extends below the lower surfaces of lift blocks 520, 522. A central vertical channel 538 is provided in lift block 536, within which a pair of spaced lift rollers 540, 542 are mounted for rotation. Lift rollers 540, 542 closely engage an axially extending lift bar 544 which is supported horizontally, as shown in FIGS. 7, 8, 19, 20 and 22, by an infeed support link 546 pivoted between side plates 366 and by a discharge support link 548 pivoted between frame plates 378. As shown in FIG. 7, an air cylinder 550 is mounted on the to central frame plate 378 by means of a pivot 552, the actuator rod of cylinder 550 being attached to a pivot 554 between lift bar 544 and discharge support link 548.

Thus, as cylinder 550 extends and retracts, lift bar 544 is raised and lowered while remaining in a horizontal position, so that central side flap folding mechanisms 492, 502 are raised and lowered on lift rods 514, 516. Lift blocks 520, 522 also support a transverse lift shaft 556 which passes through bores 558 provided in blocks 520, 522 at a location above lift bar 544. Lift shaft 556 extends transversely through openings provided in frame plates 376–380 and side plates 392–396, as shown in FIG. 19. Side flap and corner flap folding mechanisms 494–500 and 504–510 are mounted on lift shaft 556 for upward and downward movement therewith.

Figure 21:
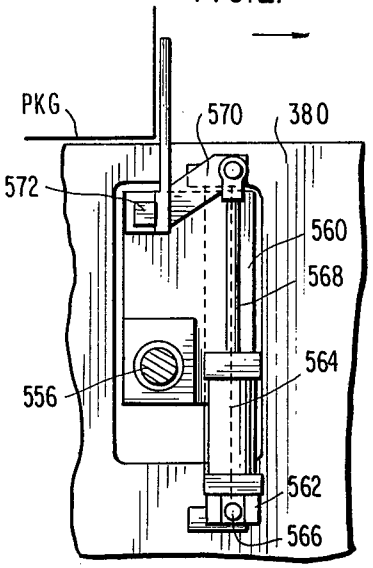
FIGS. 21 and 22 are views taken along lines 21—21 and 22—22 of FIG. 19, illustrating bottom side flap folding mechanisms according to the invention.

Those skilled in the art will appreciate from inspection of FIGS. 19–21 that flap folding mechanisms 494, 496 are identical to flap folding mechanisms 508, 510 and that flap folding mechanisms 498, 500 and 504, 506 are opposite-handed versions of mechanisms 494, 496 and 508, 510. In the following description, these folding mechanisms are considered to be functionally identical and are not referred to as being either right-handed or left-handed. As shown in FIGS. 19 and 20, lift blocks 560 are mounted by suitable ball bushings on lift rods 512, 518. A downwardly extending plate 562 is attached to each of lift blocks 560 to support an air cylinder 564 at pivot 566. The actuator rod 568 of cylinder 564 is pivoted to a flat-sided folding finger 570 which is mounted on a shaft 572 supported by lift block 560 at pivot 574. This structure is included in each of folding mechanisms 494, 498, 504 and 508. Also attached to lift block 560 is a downwardly extending plate 576 which is mounted at an angle $\alpha$ of approximately 45° relative to the axis of the adjacent frame plate 376, 380. An air cylinder 578 is supported by plate 576 at pivot 580 and includes an upwardly extending actuator rod 582. A stub shaft 584 extends from support plate 576 near its upper end and supports a pivot block 586 from which a radial arm 588 extends for connection to actuator rod 582. The top surface of pivot block 586 is machined away to provide an upwardly extending surface 590 which is set at an angle of approximately 45° relative to the axis of stub shaft 584, thus making surface 590 parallel to the axis of lift shaft 556. Attached to surface 590 by suitable means is a flat-sided corner flap folding finger 592. When finger 592 is in its elevated position as shown in FIGS. 19 and 20, it extends from pivot block 586 at an angle $\beta$ of approximately 64° above the horizontal. As illustrated in FIGS. 19–21, the side flap folding fingers are in the elevated positions to which they move while folding a bottom side flap to upwardly extending position adjacent the sides of a ream of paper and in which they remain until folding of the top flaps has commenced. When the actuator shafts 530, 568, 582 are retracted, the folding fingers 532, 570 and 592 are rotated away from their illustrated positions to essentially horizontal positions, not illustrated.

End flap folding mechanisms 484, 490 are identical and mechanisms 486, 488 are opposite-handed versions of them. As shown in FIGS. 19 and 20, each of these mechanisms comprises a mounting plate 594 which extends inwardly from the outermost of frame plates 376, side plates 392, frame plates 380 or side plates 396, as appropriate. A cylinder 596 is pivotably supported by mounting plate 594 and includes an actuator rod 598 which is pivoted to a flat-sided bottom end flap folding finger 600 pivotably mounted on a mounting plate 602 which extends outwardly from the associated frame plate or side plate. While end flap folding mechanisms 486 and 490 are not mounted for vertical movement, they are movable axially as will be discussed subsequently.

Adjusting for Reams of Different Sizes

The apparatus according to the present invention is adjustable to accommodate reams or other similarly shaped products and corresponding carton blanks having different lengths, widths and heights. The apparatus also may be adjusted to operate in such a manner that the right side or the left side or the center of the ream will be fixed during packaging operations. As previously indicated, the central conveyor carriage 388 shown in FIG. 17 is fixed against transverse movement relative to main frame 92–98. If it is desired that packages be moved through the apparatus along a center line which is fixed relative to the underlying floor, then vertical frame legs 94 are positioned directly on the floor and the main frame is leveled using suitable leveling screws (not shown). However, if it is desired to move reams through the apparatus with their right or left side always on a fixed line relative to the underlying floor, then provision must be made for adjusting the transverse position of the main frame 92–98 as the transversely measured dimension of the product changes.

FIGS. 16 and 17 show a fixed inner frame 604 which stands on the underlying floor and comprises a pair of axially extending parallel support rails 606, 608 joined transversely by an infeed tie rail 610, a central tie rail 612 and a discharge tie rail 614. Extending upwardly from the tie rails are transversely spaced pairs 616, 618 and 620 of ball bushing blocks through which extend an infeed adjustment shaft 624, central adjustment shaft 626 and discharge adjustment shaft 628, the adjustment shafts being rigidly attached to the left and right bottom side rails 96. Bushing blocks 616–620 include at their upper ends screw nuts 630, 632, 634 which are engaged with lead screws 636, 638, 640 for adjustment of the transverse position of main frame 92–98. A double-chain sprocket 642 operatively associated with lead screw 636, an idler double-chain sprocket 643, a double-chain sprocket 644 associated with lead screw 638 and a double-chain sprocket 646 associated with lead screw 640 are interconnected by roller chains 648, 650 and 652 so that when the chain sprockets are rotated, the lead screws 636–640 move synchronously to adjust the position of the main frame relative to inner frame 604.

Transverse adjustment of conveyor support frames 358, 362 and carriages 386, 390 is achieved by means of a pair of dual-handed adjustment lead screws 654, 656 which extend between the right and left top side rails 92 and include unthreaded central portions 658 engaged with central support 196 and central frame plates 378. Lead screws 654, 656 include at either end a pair of opposite-handed threaded portions 660, 662 which are engaged with screw nuts 664, 666 on frame plates 376 and 380, respectively; and with screw nuts 668, 670 on supports 198 and 200. The drive for lead screws 654, 656 is provided via a double chain sprocket 672 mounted on an extension of lead screw 656 and a chain 674 which extends from sprocket 672 to sprocket 646. A hand wheel 676 is mounted on an extension of lead screw 656. At the infeed end of the apparatus, a sprocket 678 is mounted on an extension of lead screw 654 and connected by a chain 680 to sprocket 672, as shown in FIG. 18. Lead screw 654 also includes at both ends a further chain sprocket 682, only one of which is illustrated schematically in FIG. 18. Sprocket 682 is connected via a chain 684 which extends upwardly as illustrated in FIG. 16 and meshes with sprocket 340 illustrated in FIG. 11.

The adjustment mechanisms shown in FIG. 17 may be used to position either of conveyor support frames 358, 362 and carriages 386, 390 at a transverse position which is constant relative to fixed inner frame 604, regardless of the size of the ream to be packaged. For example, if it is assumed that lead screws 636, 638 and 640 are right-handed; that threaded portions 662 also are right-handed; that the lead screw 338 which would be provided on the opposite side from that illustrated in FIG. 11 is right-handed; and that all other transverse lead screws or lead screw portions are left-handed, then the transverse adjustment would be made as follows. By rotating hand wheel 676 in the clockwise direction, lead screws 654 and 656 will cause conveyor support frames 358, 362 and 390 to move inwardly toward conveyor support frame 360 and carriage 388 which remain fixed relative to main frame 92–98. Simultaneously, rotation of lead screws 636, 638 and 640 causes main frame 92–98 to move toward the left side of the apparatus so that the position of conveyor carriage 390 remains constant relative to inner frame 604. Rotation of lead screw 654 also causes sprocket 682 to drive chain 684 and sprockets 340 as shown in FIG. 11, so that screw nuts 336 cause cylinders 322 and their associated side guide rails 342 to move toward the center of the apparatus. In the example just given, the guide rail 342 on the left side of the machine would maintain a constant position relative to inner frame 604. By reversing the hand of the various transverse lead screws, the apparatus may be arranged to maintain conveyor carriage 386 and right side guide rail 342 in a fixed position.

As discussed with regard to FIGS. 17 and 19, carriages 386–390 are supported in part by an axially movable transverse guide rod 354 supported at its opposite ends by adjustment blocks 400, 402, these blocks being mounted for axial movement on support bars 404, 406. By moving carriages 386–390 axially, the folding mechanisms mounted on side plates 392–396 are moved relative to the folding mechanisms mounted on frame plates 376–380 so that the apparatus can be adjusted to accommodate packages of varying widths. Movement of adjustment blocks 400, 402 along support bars 404, 406, as shown in FIGS. 16 and 17, is controlled by lead screws 665, 667 which are engaged with screw nuts 669 mounted in adjustment blocks 400, 402, one of which is shown in FIG. 16, and supported at their other ends by miter gear support frames 671, 673. Within these support frames, miter gears 675, 677 mounted on lead screws 665, 667 mesh with miter gears 679, 681 mounted on a transverse shaft 683 which extends between support frames 671, 673. The right end of transverse shaft 683 extends beyond top side rail 92 where it supports a suitable hand wheel 685. Thus, as hand wheel 685 is rotated, shaft 683 causes miter gears 679, 681 to rotate miter gear 675, 677 which, in turn, cause lead screws 665, 667 to move into or out of screw nuts 669, thereby causing adjustment blocks 400, 402 to move along support bars 404, 406 and thus move carriages 386–390 axially.

Driving the Conveyor Belts

Figure 23:
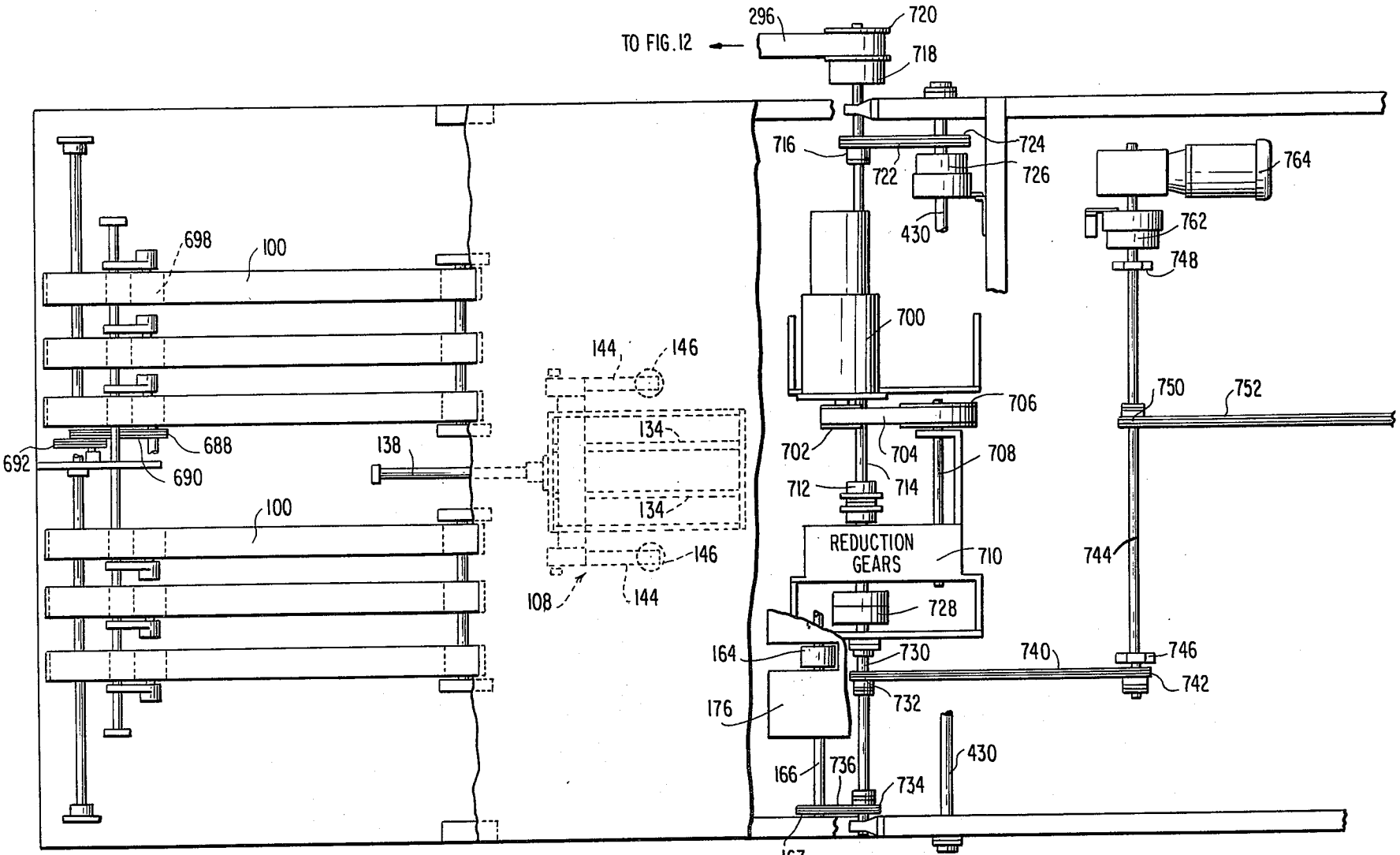
FIG. 23 is a fragmentary top view of an apparatus according to the invention illustrating various details of the infeed conveyor, the bottom carton blank feeding mechanism and the conveyor drive system.

FIGS. 6–8 and 23 illustrate schematically the system for driving the various conveyors included in the packaging apparatus according to the invention. As shown in FIG. 23, a programmable servomotor 700 is provided such as a CSR No. STG0720-228-100E which has an output pulley 702 over which a timing belt 704 extends to a pulley 706 mounted on a shaft 708. A reduction gear 710 is driven by shaft 708 and includes a first output via a coupling 712 and a shaft 714 which passes beneath servo motor 700, through a sprocket 716. On the end of shaft 714, an overload clutch 718 controls application of power to a timing belt pulley 720 over which timing belt 296 runs from the structure shown in FIG. 12. Sprocket 716 drives a chain 722 which passes over a further sprocket 724 operatively connected to shaft 430 shown in FIG. 8 via a suitable clutch mechanism 726. The other output of reduction gear 710 is via a clutch 728 having an output shaft 730 which passes through a pair of spaced sprockets 732, 734. A chain 736 extends around sprocket 734 to sprocket 167 mounted on shaft 166 as shown in FIGS. 5 and 6. From sprocket 732, a further chain 740 extends to a sprocket 742 mounted on a transversely extending shaft 744 supported by a pair of pillow blocks 746, 748. A chain sprocket 750 mounted on shaft 744 drives a chain 752 connected via idler shaft and sprockets 754 to a further chain 756 which ultimately rotates the drive sprocket 758 of the belts 760 of the discharge conveyor. When clutch 728 is disengaged under circumstances to be described subsequently, shaft 744 may be driven through clutch 762 by a motor 764. Essentially, this permits packages to move on belts 760 while partially completed packages are stationary on belts 188–194.

Feeding and Positioning a Top Carton Blank

Figure 24:
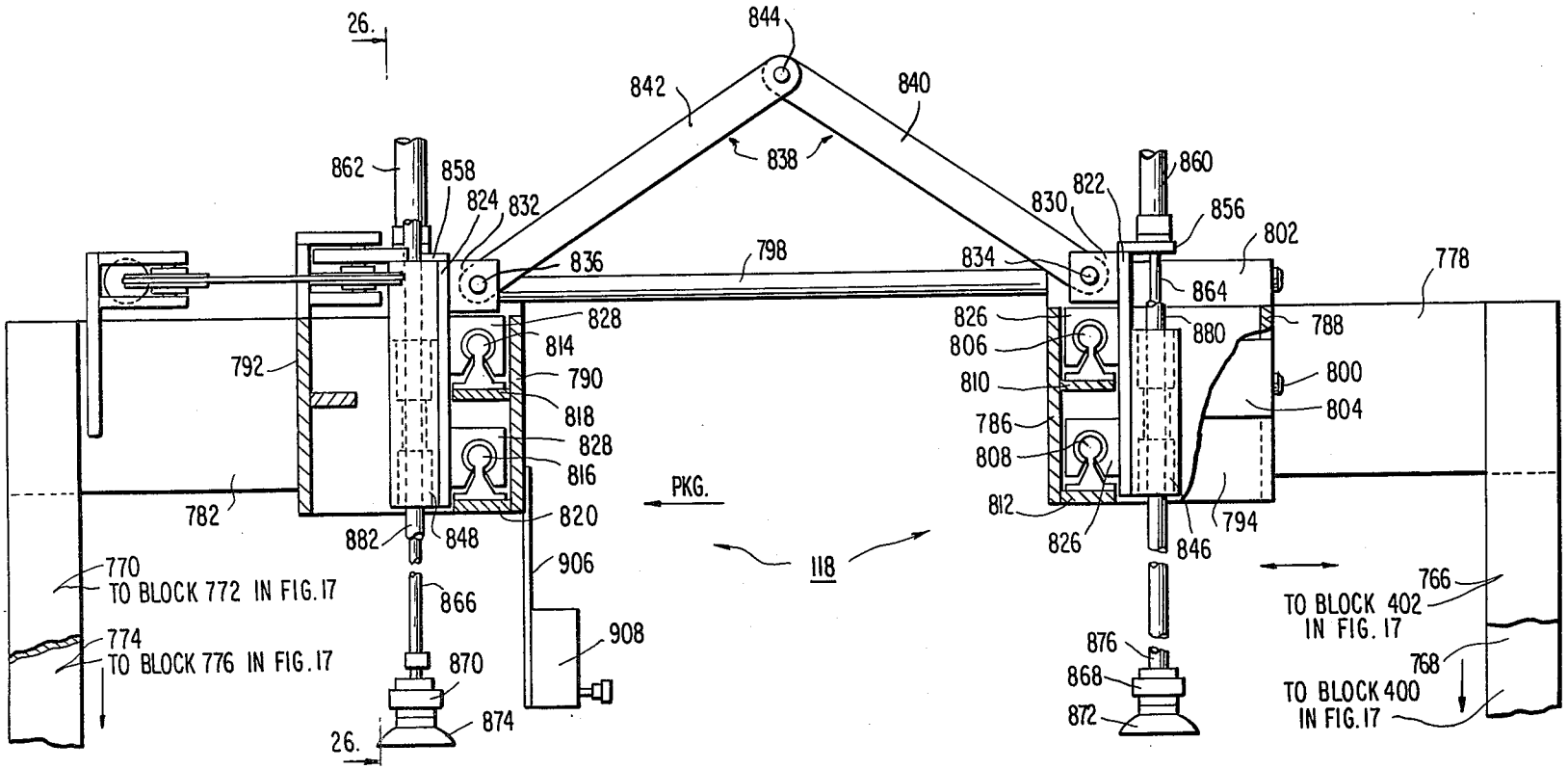
FIG. 24 is an elevational, partially sectioned view taken along line 24—24 of FIG. 3, illustrating various details of the top carton blank feeder mechanism according to the present invention.
Figure 25:
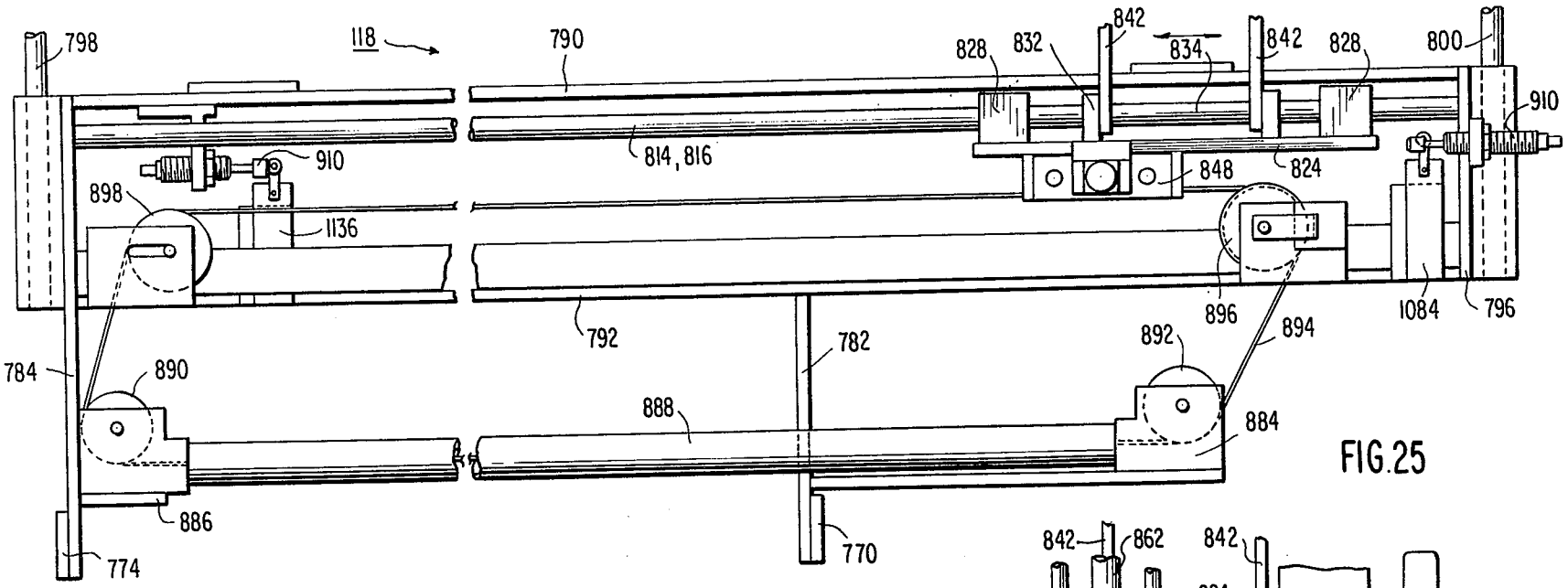
FIG. 25 is a top view taken along line 25—25 of FIG. 26.
Figure 26:
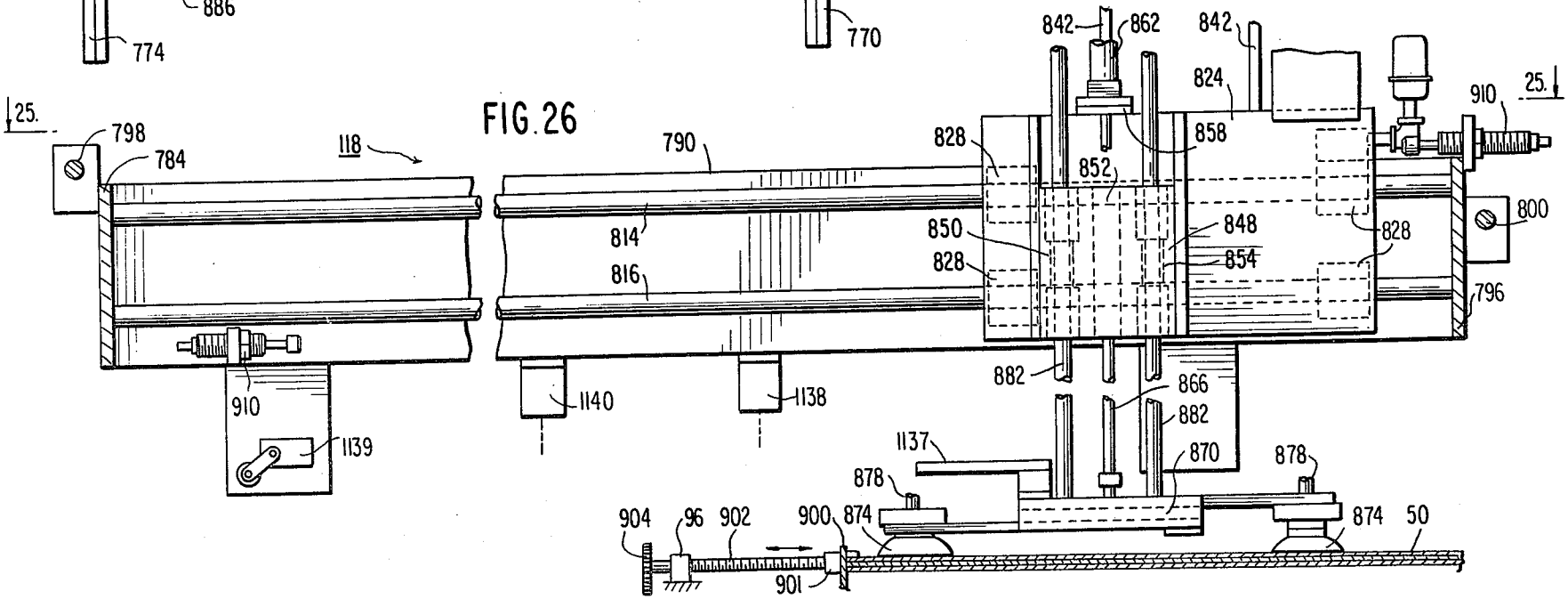
FIG. 26 is an elevational view taken along line 26—26 of FIG. 24.

FIGS. 24–26 illustrate the top carton blank feeding mechanism used in the present invention. A pair of vertical support plates 766, 768 are attached to axially movable adjustment blocks 402, 400 as seen most clearly in FIG. 17. Similarly, a vertical support plate 770 is attached to a fixed support block 772 mounted on the inside of left top frame rail 92 and a vertical support plate 774 is mounted on a fixed support block 776 mounted on the right top frame rail 92. Attached to support plates 766, 768 at their upper ends is one of a pair of axially extending horizontal side plates 778, only one of which is shown in FIG. 24. Similarly, a pair of axially extending horizontal side plates 782, 784 are attached to the upper ends of vertical support plates 770, 774, respectively. A transversely extending rail plate 786 and a transversely extending support plate 788 are supported by side plates 778 and, similarly, a transversely extending rail plate 790 and transversely extending support plate 792 are supported by side plates 782, 784. The outer ends of the rail and support plates are joined by end plates 794, 796 to complete a rigid support structure for the top carton blank feeding mechanism. An axially extending horizontal guide rod 798 is fixedly attached to side plate 784 and a further axially extending horizontal guide rod 800 is fixedly attached to end plate 796 at the opposite ends of the support structure. The other ends of guide rods 798, 800 are supported, respectively, by a ball bushing 802 mounted on the outside surface of the side plate 778 attached to the upper end of vertical support plate 768 and by a ball bushing 804 mounted on end plate 794.

Between rail plate 786 and support plate 788 are mounted a pair of transversely extending, vertically spaced, horizontal support rails 806, 808 which are mounted respectively on support plates 810, 812 attached to rail plate 786. Similarly, between rail plate 790 and support plate 792 are mounted a pair of transversely extending, vertically spaced, horizontal support rails 814, 816 which are mounted, respectively, on support plates 818, 820 attached to rail plate 790. Slidably mounted on support rails 806, 808 is an infeed slide plate or carriage 822; and on support rails 814, 816, a discharge slide plate or carriage 824. Movement of slide plates 822, 824 on their associated rails is facilitated by sets of ball bushings 826, 828. As shown in FIG. 24, slide plates 822 and 824 include at their upper ends oppositely facing infeed pivot block 830 and discharge pivot block 832 which support transverse shafts 834, 836. An articulated synchronizing arm 838 is pivoted to shafts 834, 836 and comprises a driven arm 840 and a driver arm 842 joined by a pivot shaft 844. Synchronizing arm 838 ensures that slide plates 822, 824 move together along their respective support rails when the top blank feeding mechanism is actuated.

On the opposite sides of slide plates 822, 824 from pivot blocks 830, 832 are attached an infeed guide block 846 and a discharge guide block 848. As shown in FIG. 26, each guide block 846, 848 includes transversely spaced, vertically extending parallel bores 850, 852, 854. Positioned above central bore 852 and extending over guide blocks 846, 848 are cylinder mounting plates 856, 858. A pair of vertically arranged air cylinders 860, 862 extend upwardly from mounting plates 856, 858 as illustrated fragmentarily in FIGS. 24 and 26. FIG. 26 is a view taken along line 26—26 of FIG. 24 in which appear various components of the fixed discharge side of the top carton blank feeding mechanism. It should be understood that a corresponding view taken on the infeed side of the mechanism would reveal virtually identical components arranged in an opposite-handed manner. Thus, the following discussion pertains to both the infeed and discharge sides of this particular mechanism. Cylinders 860, 862 comprise downwardly extending actuator shafts 864, 866 which pass through central bores 852 and are attached to infeed vacuum cup support bar 868 and discharge vacuum cup support bar 870. The vacuum cup support bars extend transversely and support at their opposite ends conventional vacuum cups 872, 874 which are powered from vacuum lines 876, 878 in the usual manner. Parallel guide rods 880, 882 extend upward from support bars 868, 870, respectively, and pass through bores 850, 854 in guide block 848, via conventional ball bushings.

While the previously described structure is common to both the infeed and discharge sides of the top blank feeding mechanism, FIG. 25 illustrates structure found only on the discharge side of the mechanism. Brackets 884 and 886 are attached to side plates 782, 784 and support a transversely extending cable cylinder 888 of conventional design which includes at its opposite ends a pair of pulleys 890, 892. A cable 894 attached to the piston of the cylinder passes from cylinder 888 around a further pair of pulleys 896, 898 attached by suitable brackets to support plate 792. Cable 894 is fixedly attached to discharge guide block 848. Thus, as the piston of cable cylinder 888 moves along within the cylinder, guide block 848 is caused to move along its associated support rails 814, 816. Simultaneously, due to the influence of synchronizing arm 838, guide block 846 is caused to move along its associated support rails 806, 808.

Referring again to FIG. 26, a stack of top carton blanks 50 is illustrated schematically. As the blanks are placed within the hopper of elevator 112 shown schematically in FIGS. 2 and 3, their leading edges come into contact with an end stop 900 which is engaged via a suitable screw nut 901 with a lead screw 902 driven by a sprocket 904. When a change in ream length requires the use of a top carton blank having a correspondingly different length, lead screw 902 is rotated as necessary to move end stop 900 and thereby position the leading edges of the top carton blanks so that at the end of the travel of cable cylinder 888, the top carton blank will be properly positioned transversely relative to the ream to be packaged. Of course, when carriages 386–390 are moved axially to accommodate reams of different widths, the right or infeed side of the mechanism shown in FIG. 24 is moved simultaneously to accommodate top carton blanks having a correspondingly different width.

In operation, the mechanism shown in FIGS. 24 to 26 removes top carton blank 50 from elevator 112, moves it transversely to a position above ream 10 as it rests on bottom carton blank 24 and then places top carton blank on the top surface 12 of the ream with score lines 54, 56 and 66, 68 aligned with sides 16, 18 and ends 20, 22 to facilitate downward folding of flaps 58, 60 and 70, 72. To indicate that a top carton blank has been picked up by vacuum cups 872, 874, a downwardly extending bracket 906 is attached to rail plate 790 to provide a support for a limit switch 908 having a conventional roller arm which contacts each top carton blank as it is raised by vacuum cups 872, 874. When no blanks are present, a further stack may be elevated as will be understood by those skilled in the art.

Folding the Flaps of A Top Carton Blank

Figure 29:
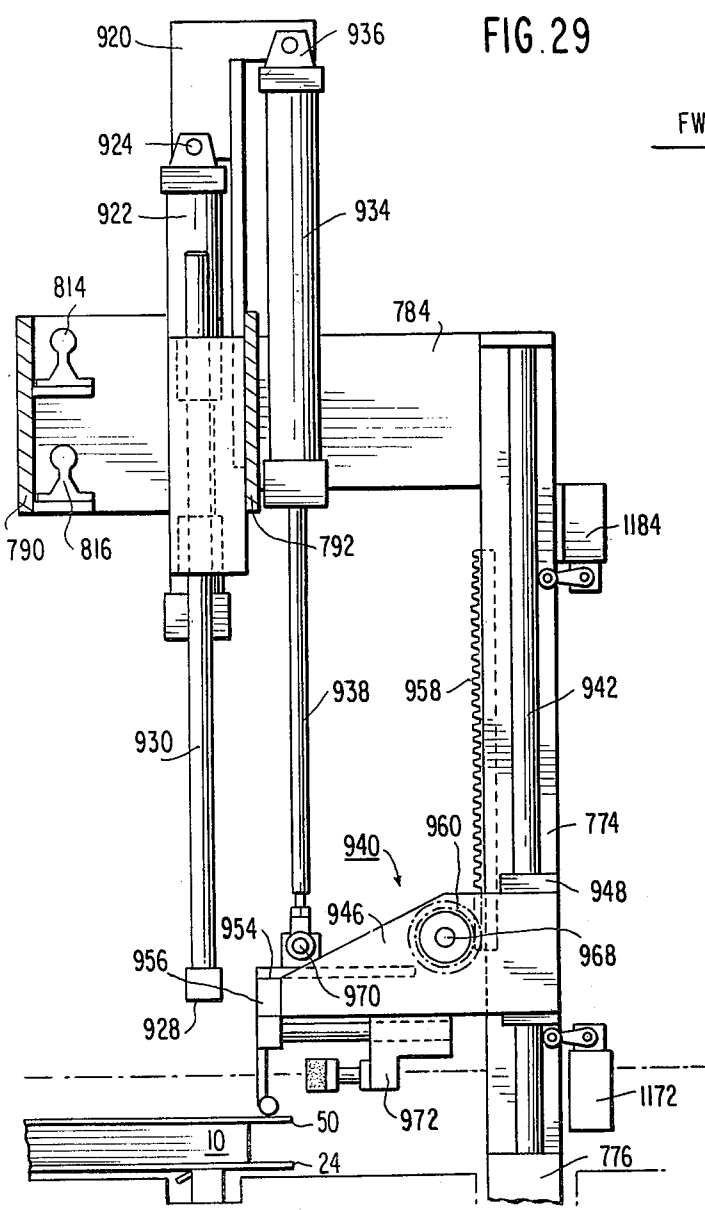
FIG. 29 is a view taken along along line 29—29 of FIG. 3.

FIGS. 27–34 illustrate the mechanisms which fold the side flaps, end flaps and corner flaps of each top carton blank 50 into position adjacent the previously folded flaps of the bottom carton blank 24. FIGS. 27–29 and 32–34 illustrate the mechanism which folds top leading side flap 58 and top leading side corner flaps 62, the mechanism being supported by vertical support plates 770, 774, rail plate 790 and support plate 792 which were previously described with regard to FIGS. 24–26. The mechanism shown in FIGS. 27–29 is mounted on support blocks 772, 776 as indicated in FIG. 17 and therefore is fixed to the main frame 92–98 of the machine. Top trailing side flap 60 and top trailing side corner flaps 64 are folded by an essentially identical mechanism mounted for axial movement on adjustment blocks 400, 402 by means of vertical support plates 766, 768 shown in FIGS. 17 and 24; however, the mechanism for folding the flaps at the trailing side of the top carton blank has not been illustrated specifically in order to simplify the description of the invention. In a similar fashion, FIGS. 30–34 illustrate the mechanism which folds top right end flap 70 downward adjacent the previously folded bottom end flap 42 and top corner flaps 62, 64. This mechanism is supported on the outside surface of the outermost one of frame plates 376 via an infeed bracket 912 and a discharge bracket 914 shown in FIGS. 17, 30 and 31. On the left-hand side of the machine, a virtually identical mechanism is supported on infeed bracket 916 and discharge bracket 918 which are attached to the exterior surface of the outermost one of frame plates 380. For simplicity of description, the mechanism mounted on brackets 916, 918 has not been shown due to its functional identity with the mechanism mounted on brackets 912, 914.

Referring simultaneously to FIGS. 27 and 29, it can be seen that a vertically extending bracket 920 is attached to the infeed side of support plate 792. On the infeed side of support plate 792, a compression cylinder 922 is attached to bracket 920 by a pivot 924. The actuator rod 926 of cylinder 922 extends downwardly and is attached at the center of a transversely extending side compression bar 928. After top carton blank 50 has been properly positioned on top of ream 10, compression bar 928 is pressed against the upper surface of the top carton blank at a position slightly spaced from side score line 54, thereby expelling air from the ream before the top side flaps are folded. A pair of guide rods 930 are attached to compression bar 928 on either side of actuator rod 924 and extend upwardly through a pair of ball bushings 932 also mounted on the infeed side of support plate 792.

On the opposite side of support plate 792, a side flap folding cylinder 934 is mounted to bracket 920 by means of a pivot 936. The actuator rod 938 of cylinder 934 extends downwardly and is attached to a transversely extending, vertically movable side folder carriage 940. A pair of vertical guide rods 942, 944 mounted, respectively, adjacent vertical support plates 774, 770 are provided to support carriage 940 for vertical movement. A right carriage plate 946 rides on guide rod 942 by means of a ball bushing 948 and a left carriage plate 950 rides on guide rod 944 by means of a ball bushing 952. Between carriage plates 944, 950 is mounted a rectangular brace plate 954. A transversely extending folder mounting bar 956 is mounted on the underside of brace plate 954 at the edge of plate 954 furthest from guide rods 942, 944. In order to accurately guide the movement of carriage 940 along guide rods 942, 944, a gear rack 958 is mounted on the inside of vertical support plate 774 in engagement with a spur gear 960 and a gear rack 962 is mounted on the inside of vertical support plate 770 in engagement with a further spur gear 964, both spur gears being mounted for rotation with a transversely extending shaft 968 supported for rotation in carriage plates 946, 950. Finally, a spherical rod end 970 joins actuator rod 938 to brace plate 954.

A side flap compression mechanism 972 is mounted centrally beneath brace plate 954 as shown in FIGS. 29 and 32–34. A pair of axially spaced, parallel slides 974 are attached to the underside of brace plate 954 in position to support a rectangular cam plate 976 for transverse sliding movement on slides 974. A drive block 978 extends upwardly from cam plate 976 through an axial slot 980 provided in brace plate 954. On the top side of plate 954, drive block 978 is pivotably connected to the actuator rod 982 of an air cylinder 984 mounted on brace plate 954 by a support plate 986. Cam plate 976 also includes a pair of transversely spaced, angled cam slots 988, 990 into which a pair of follower pins 992, 994 extend. A transversely extending mounting block 996 supports pins 992, 994 beneath cam plate 976 and via a pair of ball bushings 998 is mounted for axial movement on a pair of transversely spaced, parallel shafts 1000, 1002. A folder support beam 1004 is mounted on the undersurface of mounting bar 956 and serves to fixedly support the other ends of shafts 1000, 1002. Extending downwardly from support beam 1004 are transversely spaced brackets 1006, 1008 which support a rigid transversely oriented folder bar 1010. When cylinder 934 is actuated, folder bar 1010 moves down to contact side flaps 58, 60 of each top carton blank at a location on the other side of the score lines 54, 56 from compression bar 928.

Extending from the front face 1012 of mounting block 996 are a pair of stub shafts 1014, of which only one is shown in FIGS. 29 and 32. These shafts support a transversely extending compression bar 1016 which carries on its leading edge a compression pad 1018 of a suitably resilient material such as sponge rubber. When cylinder 984 is actuated, follower pins 992, 994 are forced to move toward folder mounting bar 956 due to the inclined geometry of slots 988, 990. This causes mounting block 996 to move along shafts 1000, 1002 until compression pad 1018 is brought into contact with top side flaps 58, 60 which have been folded downward by folder bar 1010. So that pad 1018 can move past brackets 1006, 1008, it is provided with cut-outs 1020, 1022 which permit the pad to move past the brackets into contact with top side flaps 58, 60. A limit switch 1024 and actuator roller 1026 are mounted on brace plate 954 in position to indicate whether compression mechanism 972 is extended or withdrawn.

FIG. 28 is a view taken along line 28—28 in FIG. 27 and illustrates the components of the top corner flap tucking mechanism 1028. A mounting block 1030 is slidably mounted on transverse compression bar 1016 and may be locked in position by suitable set screws (not shown), as required for reams of various lengths. On the upper surface of block 1030 is mounted an air cylinder 1032 by means of a pivot 1034. The actuator rod 1036 of cylinder 1032 is pivotably connected to a straight tucker plate 1038 which, in turn, is pivotably connected to a stud 1040 mounted on block 1030. A face plate 1042 is supported outwardly from tucker plate 1038 by means of a pair of mounting studs 1044 and springs 1046 captured between face plate 1042 and tucker plate 1048. In operation, cylinder 1032 causes face plate 1042 to swing into contact with the top corner flaps 62, 64 to press them into contact with the previously folded bottom end flaps 42, 44.

Figure 30:
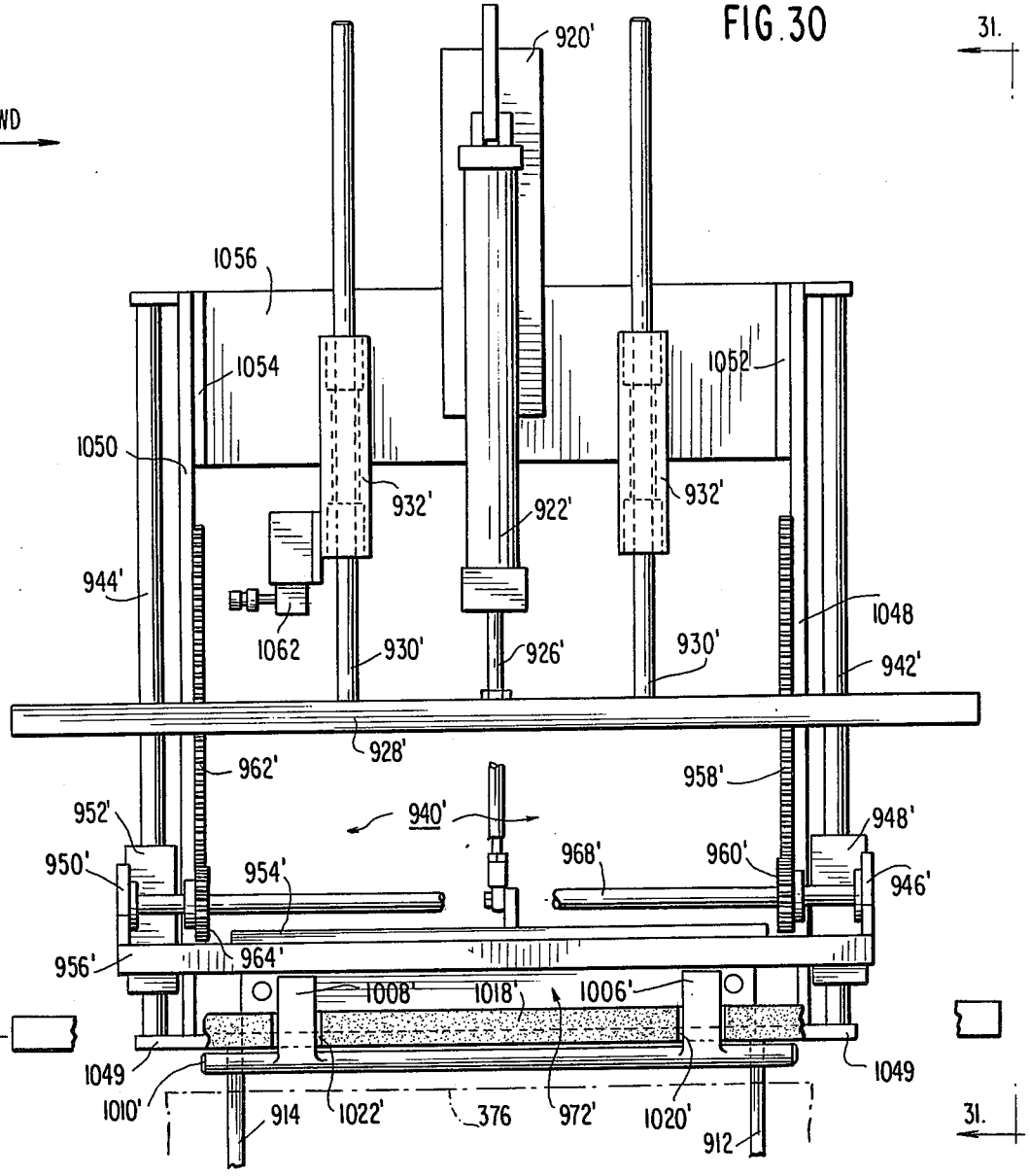
FIG. 30 is an elevational view of the top end flap folding mechanism according to the invention, taken along line 30—30 of FIG. 3.

FIGS. 30 and 31 illustrate the mechanisms which fold end flaps 70, 72 of each top carton blank. An infeed vertical support plate 1048 is mounted on the base plate 1049 supported by bracket 912 and a discharge vertical support plate 1050 is mounted on base plate 1049 supported by bracket 914. A pair of side plates 1052, 1054 extend transversely from vertical support plates 1048, 1050 and are joined at their inner ends by an axially extending tie plate 1056 to form a rigid support structure. Other than the different mounting for the folding assembly shown in FIGS. 30 and 31, its components are functionally identical to those illustrated in FIGS. 27, 29, 30 and 32–34. No corner flap tucking mechanism is required in this instance. Accordingly, the corresponding elements are identified by primed numbers (e.g., 920') and will not be specifically described. An upper limit switch 1058 and a lower limit switch 1060 indicate the presence of carriage 940' at its uppermost and lowermost positions, respectively. A limit switch 1062 mounted upon the side of one of ball bushings 932' is positioned to be actuated by compression bar 928' in its uppermost position.

Operating the Apparatus

Figure 35:
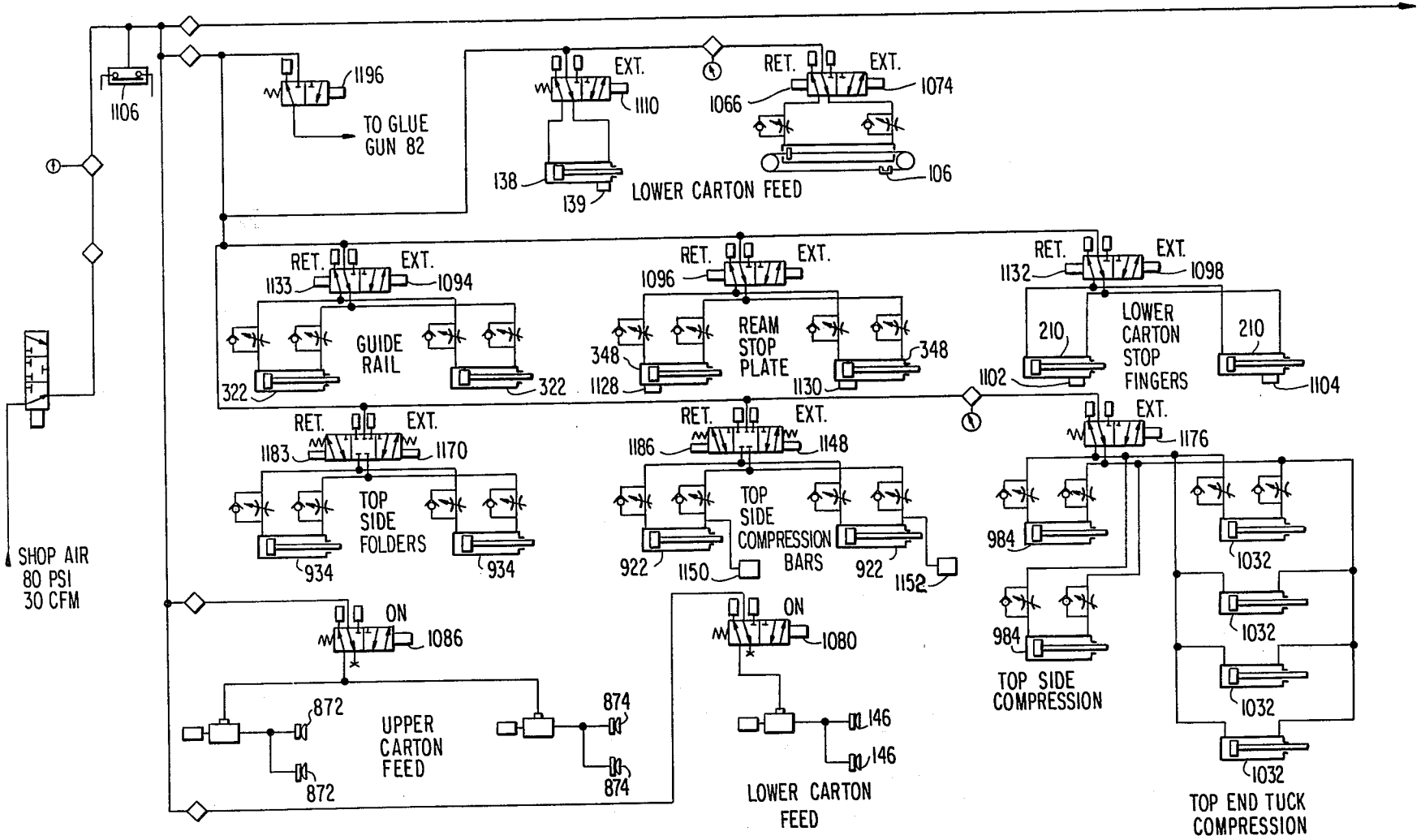
FIGS. 35 and 36, taken together, illustrate the pneumatic control circuitry used in the apparatus according to the present invention.
Figure 36:
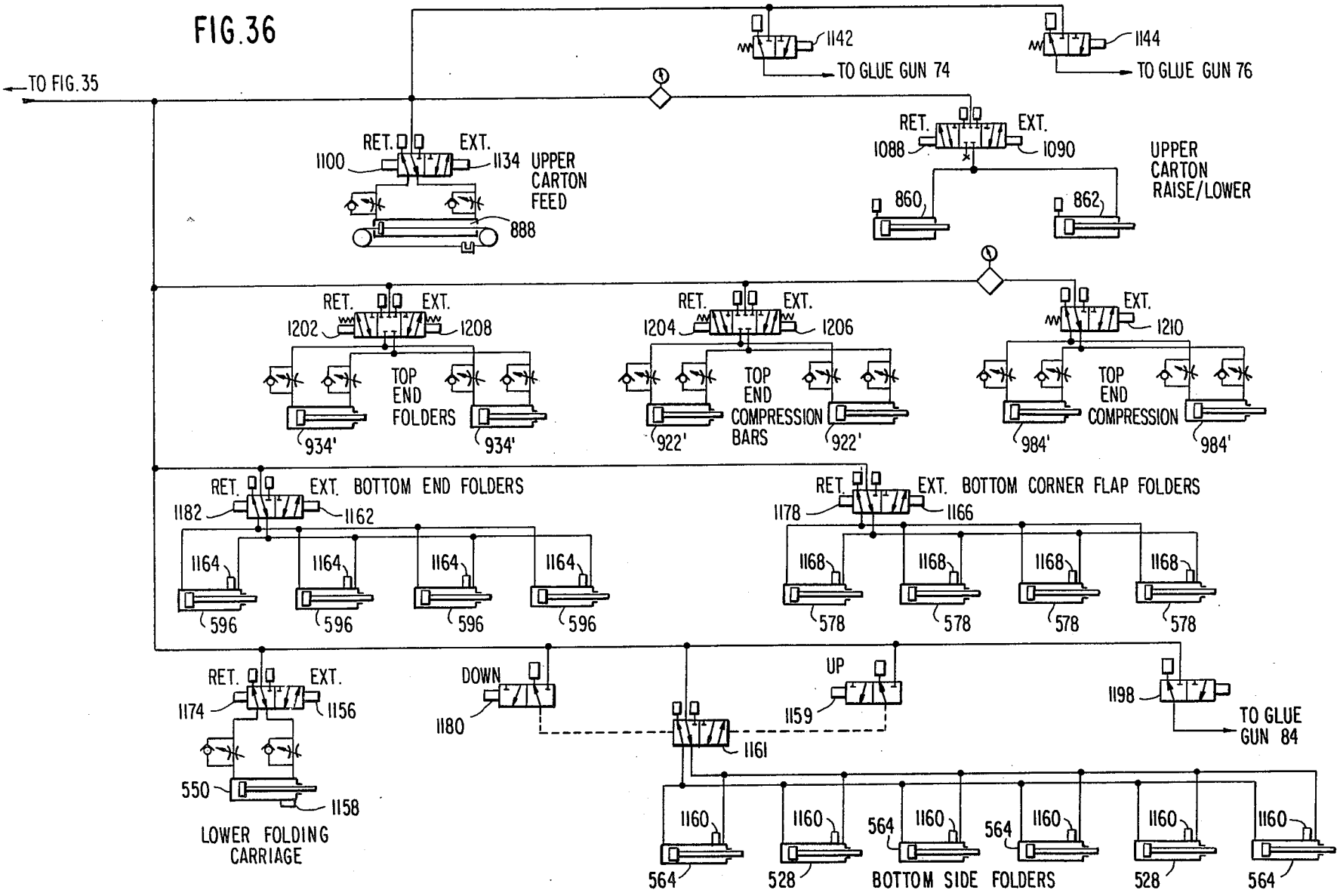

The operation of the packaging apparatus according to the invention will now be described. The positions of various elements of the invention are monitored by a number of limit switches and electric eye and reflector pairs, as a ream is packaged. In response to the outputs of these sensors, the air cylinders and motors previously referred to are actuated by solenoid controlled valves and switches in the familiar manner. The pneumatic control system for the apparatus of the invention is shown in FIGS. 35 and 36 and, although the electrical side of the control system has not been illustrated, those skilled in the art will appreciate that coordination of the valve operations can be achieved using commercially available programmable controllers or a conventional electromechanical switch and relay control system.

Whichever type of controller is used, the sequence of operation of the apparatus proceeds in essentially the following manner. Infeed conveyor 90 is started and blower 214 is started to provide a flow of air through air table 102. Then, as reams 10 or similarly shaped products move along conveyor 90, they eventually break the beam of an electric eye and reflector pair 1064, the output of which indicates the presence of a ream on infeed conveyor 90. As soon as this light beam is broken, infeed conveyor 90 is stopped until the packaging apparatus is ready to receive a ream. Assuming that no bottom carton blanks 24 are available for delivery by trolley 106, then lower carton trolley retract solenoid 1066 (FIG. 35) will be energized to pull trolley 106 outward to the position illustrated in FIG. 2. Simultaneously, elevator mechanism 152 will lower cradle 154 until limit switch 1070 (FIG. 6) is actuated to indicate that the elevator is at its lowermost position. The operator then loads a stack 26 of cartons 24 onto trolley 106 with the result that a limit switch 1072 (FIGS. 2 and 3) is closed to indicate the presence of cartons on trolley 106 in position for delivery to cradle 154. The operator then energizes lower carton trolley extend solenoid 1074 which causes trolley 106 to move beneath table 102 where the stack of bottom carton blanks closes limit switch 1076 (FIG. 6) to indicate the presence of bottom carton blanks in position to be lifted on cradle 154. The beam of an electric eye and reflector pair 1078 (FIGS. 4 and 6) is broken by the carton blanks which causes lower carton vacuum cup solenoid 1080 and elevator mechanism 152 to be energized, thereby raising the carton blanks toward the positions shown in FIGS. 4 and 6. Mechanism 152 continues to raise cradle 154 until the cartons close both limit switch 156 to signal the presence of lower carton blanks at feed height and a pair of limit switches 1082 (only one of which is shown in FIG. 4) to signal that the uppermost lower carton blank has contacted vacuum cups 146. When switches 156, 1082 are closed, elevator mechanism 152 lowers cradle 154 until the cradle has undergone a downward movement of approximately three to six inches. The uppermost bottom carton blank remains attached to vacuum cups 146 in position to be moved toward rollers 164, 168 shown in FIGS. 4 and 5. Since no bottom carton blank has been positioned against stop fingers 184, the beams of electric eye and reflector pairs 1112, 1114 (shown schematically in FIGS. 10 and 11) will be unbroken. In response to this condition, clutch 762 is engaged and motor 764 is started to drive rollers 164. Then bottom carton blank 24 is inserted between rollers 164, 168 and moved into contact with stops 184 which were elevated when the previous ream had stopped at station 110. Movement of the lower carton blank is controlled by energization of vacuum pick-up extend solenoid 1110 (FIG. 35) which actuates air cylinder 138 in the manner previously described. When the lower carton blank has moved into contact with stop fingers 184, the beams of electric eye and reflector pairs 1112,

1114 are broken. After a short time delay, clutch 762 is disengaged so that rollers 164 stop.

If the hopper and elevator 112 do not include a supply of top carton blanks 50, then a stack of blanks must be provided before packaging operations may continue. Assuming that infeed and discharge slide plates 822, 824 have been retracted to the position shown in FIGS. 24–26, then a limit switch 1084 shown in FIG. 25 will be closed. Elevator 112 will then lower from feed station 114 to hold station 116, thereby closing a limit switch, not illustrated. The operator then actuates elevator 112 to raise a stack of top carton blanks to feed station 114 as illustrated in FIG. 2. The elevator then is stopped until the stack of cartons at feed station 114 has been exhausted.

For the following discussion, it will be assumed that a partially packaged ream is resting at initial carton folding and assembly station 110, as indicated schematically in FIG. 2. Then, with lower and upper carton blanks positioned as previously described, the following initial conditions are established before automatic packaging operations continue. Proximity switch 300 has closed to indicate that the pusher plate 248 is in its "home" position. Guide rail extend solenoid 1094 (FIG. 35) is energized to actuate cylinders 322 and move guide rails 342 away from the center of the machine. Stop plate retract solenoid 1096 has been energized to actuate cylinders 348 and position stop plates 344 parallel to the path of a ream moving on table 102. A lower carton stop extend solenoid 1098 has been energized at the time the previous ream stopped at station 110, to actuate cylinders 210 and raise stop fingers 184 to the positions shown in FIG. 4. Extension of cylinders 210 causes closure of limit switches 1102, 1104 mounted on the cylinders to indicate that stop fingers 184 have been elevated. Upper carton trolley retract solenoid 1100 has been energized to actuate cable cylinder 888 and cause slide plates 822, 824 to move to the positions shown in FIGS. 24–26. Finally, a limit switch 1106 must be closed to indicate that adequate air pressure is available, as indicated in FIG. 35.

Infeed conveyor 90 is started as soon as the previous conditions are satisfied. A ream 10 then moves from infeed conveyor 90 onto feed belt 100 which continues to run until the ream has passed through the beams of electric eye and reflector pairs 1116, 1118 and 1120 and moved between guide rails 342. See FIGS. 3 and 10. Infeed conveyor 90 continues to run until the beam of electric eye 1064 is blocked by the following ream. Electric eye 1116 is positioned close to the infeed edge of conveyor 100 in order to indicate the presence of a ream which would be clear of pusher plate 248 during its downward movement. Electric eye 1118 is positioned further along conveyor 100 in position to indicate the presence of a ream which would block the downward movement of pusher plate 248. Finally, electric eye 1120 is positioned to indicate that the ream has moved onto air table 102 between guide rails 342 and is no longer blocking movement of pusher plate 248. Guide rails 342 are then moved inward to align and position the ream. Simultaneously, stop plates 344 are positioned transversely to the path of the ream and motor 700 is started to drive pusher plate 248. Approximately midway along the axial length of guide rails 342, an electric eye and reflector pair 1122 directs its beam through an appropriate opening in guide rails 342 to indicate that a ream is positioned between the guide rails. Finally, an electric eye and reflector pair 1124 is positioned at the discharge end of guide plates 342 in position to direct its beam through an opening in guide rails 342 so that the beam will be broken when a ream is positioned on table 102 against stop plates 344.

Since servomotor 700 has started, pusher plate 248 moves from its home position as timing belt 296 actuates the mechanism illustrated in FIGS. 11–14. The pusher plate moves downward and then axially into contact with the trailing side 18 of ream 10 and drives the ream forward against stop plates 344 at which time servomotor 700 stops. While ream 10 is moving toward stop plates 344, solenoid 1086 shown in FIG. 35 will be energized to actuate vacuum cups 872, 874. Upper carton retract solenoid 1088 will be de-energized and upper carton extend solenoid 1090 will be energized (FIG. 36) so that cylinders 860, 862 extend vacuum cup support bars 868, 870 downward until the uppermost top carton blank is contacted by vacuum cups 872, 874. After a short time delay, solenoid 1090 will be de-energized and solenoid 1088 will be energized to lift the uppermost top carton blank from the stack of blanks to a position several inches above that illustrated in FIG. 2. Once this happens, limit switch 908 shown in FIG. 24 will be closed to indicate that the vacuum cups have engaged and lifted a top carton blank. Once the ream is in position against stop plates 344, the controller verifies that the folding operations on the previous ream have been completed at initial carton folding and assembly station 110. When these conditions are satisfied, the initial indexing operation may be completed. Stop plates 344 are retracted by energizing solenoid 1126 which actuates cylinders 348. When the stop plates are fully retracted, limit switches 1128, 1130 mounted on cylinders 348 are closed. Simultaneously with energization of solenoid 1126, lower carton stop retract solenoid 1132 is energized to actuate cylinders 210, thereby lowering stop fingers 184 and clearing the way for movement of the bottom carton blank and ream into initial carton folding and assembly station 110.

When stop plates 344 open, clutch mechanism 726 and clutch 728 shown in FIG. 23 are engaged. Servomotor 700 now is started so that rollers 436–442 and conveyor belts 188–194 begin to rotate, thereby moving the previous ream toward station 120 and moving the following ream into station 110. Discharge belts 760 and blank drive rollers 164 also are driven by servomotor 700 and will continue to be driven in this manner as long as pusher plate 248 is moving. Rollers 164 are rotated at this time so that the bottom carton blank and ream move together onto belts 188–194 without any slippage which would cause misalignment of the leading edge of the ream with the side score line 30 of the bottom carton blank. When the beams of electric eye and reflector pairs 1112, 1114 are reestablished, the next bottom carton blank is elevated into engagement with vacuum cups 146 for feeding in the manner previously described.

When the lower carton blank 24 and ream 10 begin to move into position for folding of the bottom side and end flaps, slide plates 822, 824 of the top carton blank feeding mechanism begin to move from the retracted positions shown in FIGS. 25 and 26. This occurs because extend solenoid 1134 is energized when servomotor 700 starts, thus actuating cable cylinder 888 (FIG. 36). While top carton blank 50 is moving from its starting position within top carton blank hopper and elevator 112, the passage of its leading edge breaks and of its trailing edge restores the beams of electric eye and reflector pair 1138, 1140 shown schematically in FIGS. 3 and 26. The breaking and restoring of these beams is used to control the actuation of glue guns 74, 76 shown in FIGS. 1 and 2 which apply glue to the undersides of top side flaps 58, 60 as top carton blank 50 moves into position above ream 10 and lower carton blank 24. Glue guns 74, 76 are actuated by solenoids 1142, 1144 (FIG. 36).

Movement of ream 10 and bottom carton blank 24 into station 110 is controlled by servomotor 700 which rotates a predetermined number of turns and stops. Arrival of the ream and blank at this position is detected by breakage of the beam of an electric eye and reflector pair 1146 shown in FIGS. 17 and 19. When top carton blank 50 is in position above the underlying ream and bottom carton blank, slide plate 824 engages and actuates a limit switch 1136. Just previous to engagement of plate 824 and switch 1136, a switch cam 1137 mounted on vacuum cup support bar 870 engages and actuates a limit switch 1139, to signal the presence of a top carton blank above the ream. In response, top carton extend solenoid 1090 is energized to lower the top carton blank into position on top of the ream. When switch 1139 is deactuated as switch cam 1137 moves downward, a solenoid 1148 is energized to extend cylinders 922 (FIG. 35) and bring top side compression bars 928 into contact with the upper surface of top carton blank 50. When the pressure in cylinders 922 has reached a sufficient magnitude to ensure that air has been properly expelled from ream 10, a pair of pressure switches 1150, 1152 are actuated, in response to which solenoid 1086 is de-energized causing vacuum cups 872, 874 to release the upper carton blank. Simultaneously, clutches 726 and 728 are disengaged; stop fingers 184 are raised; guide rails 342 are retracted; and servomotor 700 is started again to return pusher plate 248 to its "home" position. Actuation of switch 300 causes servomotor 700 to stop. Following release of the upper carton blank, retract solenoid 1088 causes cylinders 860, 862 to raise vacuum cup support bars 868, 870 until limit switch 1139 is actuated by cam 1137. Retract solenoid 1100 is then energized to actuate cable cylinder 888 so that slide plates 822, 824 are retraced to their illustrated positions and switch 1084 is actuated.

In response to actuation of pressure switches 1150, 1152, the bottom side flap folding mechanisms illustrated in FIGS. 19–22 are raised to their operating positions by energization of extend solenoid 1156 (FIG. 36) which actuates cylinder 550 causing lift bar 544, lift block 536 and lift blocks 560 to move upwardly to their illustrated positions. As the lift blocks and lift shafts move upward, they mechanically engage an actuator 1159 (shown only in FIG. 36) which admits air to a pilot valve 1161 to control flow of air to cylinders 528 and 564. In response, folding fingers 532, 556 are rotated upward to their illustrated positions, thereby moving the bottom side flaps upward adjacent the leading and trailing sides of ream 10 and closing limit switches 1160 associated with cylinders 528, 564. When switches 1160 have closed, an extend solenoid 1162 is energized to actuate cylinders 596 which cause bottom end flap folding fingers 600 to rotate upward to their illustrated positions. Actuation of cylinders 596 causes limit switches 1164 associated with the cylinders to close, thereby energizing extend solenoid 1166 which actuates cylinders 578 to cause bottom corner flap folding fingers 592 to rotate upward and around the corner of the ream, thereby positioning corner flaps 46, 48 as shown at position D in FIG. 1. Limit switches 1168 close to indicate that the corner flaps have been folded.

While the bottom side, end and corner flaps are held in their upwardly folded positions, extend solenoid 1170 (FIG. 35) is energized to actuate cylinders 934 and cause transversely extending carriages 940 to move downward, thereby bringing transverse folder bars 1010 into contact with top side flaps 58, 60 and causing the top side flaps to fold downward toward the previously folded bottom side flaps. When carriage 940 has reached its lower limit, top side flaps 58, 60 will not have engaged the previously folded bottom side flaps but will be spaced at a small angle from them so that the glue on flaps 58, 60 does not contact the bottom flap folding fingers. Movement of carriage 940 to this position closes a limit switch 1172, shown in FIG. 29, in response to which extend solenoid 1156 is de-energized and retract solenoid 1174 is energized to actuate cylinder 550. Thus, lift bar 544 is lowered and the bottom side flap folding mechanisms move downward, thereby withdrawing the bottom flap folding fingers from the space between the top and bottom side flaps. Thus, the bottom side flap and corner flap folding fingers move downward while still in their extended positions. As the bottom folding fingers slide out of engagement with the bottom side flaps and corner flaps, the top side flaps 58, 60 engage the bottom flaps and hold them in place. After the bottom side flap and corner flap folding fingers have moved downward out of the way, an extend solenoid 1176 is energized to actuate cylinders 984 and cause rubber pads 1018 to move into contact with downwardly folded top side flaps 58, 60. Simultaneously, the top end tuck cylinders 1032 are actuated to swing face plates 1042 into contact with the top corner flaps 62, 64. This position is held for a time sufficient to allow the glue to set, after which extend solenoid 1176 is de-energized, thus allowing the compression pads 1018 to retract. Limit switches 1024 shown in FIGS. 33 and 34 then close.

Next, retract solenoid 1178 is energized to actuate cylinders 578 and retract bottom corner flap folding fingers 592. Downward movement of the bottom side flap folding mechanisms engages a mechanical actuator 1180 (shown only in FIG. 36) which causes cylinders 528, 564 to retract their associated side flap folding fingers. Simultaneously, a retract solenoid 1183 is energized to actuate cylinders 934 to raise carriages 940 and folder bars 1010. When carriages 940 have reached their uppermost positions, they close limit switches 1184, thereby causing energization of retract solenoid 1186 which actuates cylinders 922 to withdraw top side compression bars 928 until they contact and close limit switches 1188 as shown in FIG. 27. Then, a retract solenoid 1182 is energized to actuate cylinders 596 to retract the bottom end folding fingers 600. If the bottom end flaps and the top corner flaps have not been properly folded adjacent the right and left ends of the ream, the beam of electric eye and reflector pairs 1190, 1192 shown schematically in FIG. 3 will be broken to signal a malfunction and stop operation. This precaution is desirable since improperly folded bottom end flaps and top corner flaps could interfere with proper operation of glue guns 82, 84.

The ream at initial carton folding and assembly station 110 is completely packaged except that the top end flaps 70, 72 are still extending transversely as shown at position E in FIG. 1. After compression bars 928 have closed limit switch 1188 and when a following ream is in position against stop plate 344, servomotor 700 is started and clutches 726 and 728 are engaged. Thus, the partially packaged ream moves onto discharge belt 760, and the infeed rollers 164 are started as the following ream and bottom carton blank move into station 110. As the ream moves onto discharge belt 760, it breaks the beam of an electric eye and reflector pair 1194 shown in FIGS. 2 and 3, thereby energizing solenoids 1196 and 1198 which control operation of glue guns 82, 84. A line of glue thus is applied to the ends of the package. The package continues to move on discharge belt 760 until clutches 726, 728 disengage and servomotor 700 stops. At the same time, the package breaks the beam of an electric eye and reflector pair 1200 shown in FIG. 3, indicating that the ream is in position for folding of the top end flaps. Retract solenoids 1202 and 1204 (FIG. 36) are de-energized and extend solenoids 1206, 1208 are energized to cause end compression bars 928' and end flap folder bars 1010' to be moved downward, thereby folding the top end flaps downward adjacent the previously folded bottom end flaps and top corner flaps. Downward movement of carriage 940' causes limit switches 1058 to open and 1060 to close, in response to which an extend solenoid 1210 is energized to actuate cylinders 984' and cause compression pads 1018' to move into contact with the downwardly folded top end flaps. Limit switches 1024' therefore open and after a time delay, solenoid 1210 is de-energized so that the compression pads 1018' retract. Solenoid 1202 is energized to retract end flap folder bars 1010' and solenoid 1204 is energized to retract end compression bars 928'. When limit switches 1058, 1062 have closed, clutch 762 engages and motor 764 starts to drive discharge conveyor 760 so that the completed package moves onward for subsequent processing such as labeling. When the beam of electric eye and reflector pair 1200 is reestablished, clutch 762 disengages.

Having described our invention in sufficient detail to enable those skilled in the art to make and use it, we claim:

1. An apparatus for packaging objects of the type having a rectangular parallelepiped configuration with top, bottom, side and end surfaces, comprising a source of objects to be packaged; first conveying means for receiving a series of objects from said source and moving them along an essentially straight path; a source of bottom carton blanks for a package, each bottom carton blank having a plurality of foldable bottom flaps at the edges thereof for use in forming the bottom of a package, said source of bottom carton blanks comprising means for elevating and lowering a stack of bottom carton blanks beneath said path; means for positioning an object as it moves along said path at a position on a bottom carton blank which facilitates folding of the bottom flaps; means for stopping bottom carton blanks and the objects positioned thereon in positions for folding the bottom flaps; a source of top carton blanks for a package, each top carton blank having a plurality of foldable top flaps at the edges thereof for use in forming the top of a package; means for positioning a top carton blank on each object at a position which facilitates folding of the top flaps to form, in cooperation with the bottom carton blank, a package around the object; means for folding the bottom flaps upwardly adjacent each stopped object; means for folding the top flaps downwardly adjacent each stopped object to complete the package; and second conveying means for moving each completed package away from said means for folding along said path, said object positioning means having an opening transverse to said path in position to be passed over by each of the objects and said object positioning means comprising means for removing a bottom carton blank from the stack and for driving the removed bottom carton blank through said opening, means for arresting the movement of a bottom carton blank after its leading edge has moved through said opening, third conveying means for moving each object from said first conveying means along said path, means for arresting the movement of each object as it moves along said path so that the leading side of the object is positioned relative to the bottom carton blank to facilitate folding of bottom flaps on the leading edge of the bottom carton blank and fourth conveying means for moving the bottom carton blank and the object positioned thereon along said path upon release of said means for arresting movement.

2. Apparatus according to claim 1, wherein said means for removing and driving comprises a mounting frame positioned beneath said path; at least one guide rod mounted on said mounting frame parallel to said path; a slide block mounted on said guide rod; at least one vacuum cup arm pivotably mounted on said slide block; and means for moving said slide block toward and away from said opening.

3. Apparatus according to claim 2, wherein said vacuum cup arm comprises an elongated arm member and further comprising a vacuum cup attached to one end of said arm member, a cam follower roller attached to said arm member and cam means contacted by said roller as said slide block moves on said guide rod for raising a bottom blank as it moves toward said opening.

4. Apparatus according to claim 1, wherein said means for moving and driving bottom carton blanks comprises a plurality of drive rollers positioned on a shaft extending transverse to the path, means for rotating said shaft, and pinch rollers associated with at least some of said drive rollers, each of said pinch rollers being mounted on a pivot arm and resiliently biased toward its associated drive roller, whereby the bottom carton blank passes between said drive and pinch rollers as it moves toward said opening.

5. Apparatus according to claim 1, wherein said means for arresting movement of bottom carton blanks comprises a pair of stop fingers pivotably mounted on opposite sides of said path beyond said opening; and means for moving said fingers to contact the leading edge of an oncoming bottom carton blank and arrest its movement.

6. Apparatus according to claim 1, wherein said third conveying means comprises:

a support table having an upper surface onto which each object is conveyed by said first conveying means;

a pusher plate; and means for successively positioning said pusher plate in contact with the trailing side of each object and for pushing said plate and object along said path, past said means for arresting movement and onto said fourth conveying means.

7. Apparatus according to claim 6, wherein the objects to be conveyed are stacks of paper and said pusher plate comprises, on its surface in contact with the stack, wedge means for misaligning the stack so that its leading and trailing sides are angled backward toward said pusher plate.

8. Apparatus according to claim 6, further comprising means for moving each object transversely to said path to position each object relative to said fourth conveying means.

9. Apparatus according to claim 8, wherein said means for moving each object transversely comprises a pair of upwardly extending, parallel guide rails positioned on opposite sides of said path and means for moving at least one of said guide rails toward the center of said path to position each object; and said means for arresting movement of each object comprises a pair of stop plates, each pivotably mounted on one of said guide rails, and means for pivoting said stop plates into the path of the object as it is moved between said guide rails by said pusher plate.

10. Apparatus according to claim 6, wherein said means for successively positioning said pusher plate comprises:

a first pair of elongated guide elements mounted above said support table parallel to said path;

a first carriage mounted for reciprocating movement on said guide elements;

a pair of spaced chain sprockets having an endless chain engaged therewith so that said chain extends between said sprockets;

means for rotating one of said sprockets to drive said chain;

a second pair of elongated guide elements mounted on said first carriage and extended upward from said path;

a second carriage mounted on said second pair of guide elements, said second carriage being connected to said chain and including a first gear rack;

a third pair of elongated guide elements mounted on said first carriage and extended upward from said path, said pusher plate being mounted for movement thereon and including a second gear rack; and transmission means operatively connecting said first and second gear racks for driving said pusher plate as said first and second carriages are moved by said chain.

11. An apparatus for packaging objects of the type having a rectangular parallelepiped configuration with top, bottom, side and end surfaces, comprising a source of objects to be packaged; first conveying means for receiving a series of objects from said source and for moving them along an essentially straight path; a source of bottom carton blanks for a package, each such bottom carton blank having a plurality of foldable bottom flaps at the edges thereof for use in forming the bottom of a package; means for positioning an object as it moves along said path at a position on a bottom carton blank which facilitates folding of the bottom flaps of such blank; means for stopping a bottom carton blank and an object positioned thereon in position for folding the bottom flaps; a source of top carton blanks for a package, each such top carton blank having a plurality of foldable top flaps at the edges thereof for use in forming the top of a package; means for folding bottom flaps upwardly adjacent each stopped object; means for positioning a top carton blank on each object at a position which facilitates folding of top flaps to form, in cooperation with a bottom carton blank, a package around the object, comprising support rail means extending transverse to said path above said means for folding bottom flaps, a top carton blank positioning carriage mounted for movement on said support rail means, vacuum cups, vacuum cup lifting means mounted on said positioning carriage for upward and downward movement with said vacuum cups, means for raising and lowering said lifting means and means for moving said positioning carriage transversely to said path in order to transfer, by means of said vacuum cups, a top carton blank from said source of top carton blanks, to position a top carton blank on each object and to return to said source of top carton blanks; means for folding top flaps downward adjacent each stopped object to complete the package; and second conveying means for moving each completed package away from said means for folding and along said path.

12. Apparatus according to claim 11, wherein the sides of each object are at the leading and trailing edges thereof as the object moves along said path, each bottom carton blank having bottom flaps for at least partially covering the sides and the ends of the respective object after such bottom flaps have been folded, said means for folding the bottom flaps comprising third conveying means for moving a bottom carton blank and the object positioned thereon along said path until stopped by said means for stopping, first and second means positioned on opposite sides of said third conveying means for folding the flaps at the opposite ends of the bottom carton blank upward adjacent to the opposite ends of the respective object, means for folding the flaps at the leading side of the bottom carton blank upward adjacent the leading side of the respective object, and means for folding the flaps at the trailing side of the bottom carton blank upward adjacent the trailing side of the respective object.

13. Apparatus according to claim 12, wherein said third conveying means comprises:

a first endless belt;

a first roller over which said belt is trained;

a second roller over which said belt is trained at a position spaced along said path from said first roller;

means for supporting said first and second rollers;

means for mounting means for folding the bottom flaps at the trailing side at a position fixed relative to said first roller;

means for mounting said means for folding the bottom flaps at the leading side at a position fixed relative to said second roller; and means for adjusting the spacing along said path between said first and second rollers, whereby the spacing is adjusted between said means for folding the bottom flaps at the leading and trailing sides to accommodate objects and blanks having different widths.

14. Apparatus according to claim 13, further comprising a second endless belt spaced from and parallel to said first endless belt; a third roller and a fourth roller over which said second belt is trained; means for mounting said first and second means for folding the bottom flaps at the opposite ends of the bottom blanks, at positions fixed relative to said first and second endless belts; and means for adjusting the transverse spacing between said belts, whereby the transverse spacing is adjusted between said first and second means for folding the bottom flaps at the opposite ends of the bottom carton blank, to accommodate objects and blanks having different lengths.

15. Apparatus according to claim 14, further comprising a main support frame, a transversely adjustable conveyor frame, and means for adjustably supporting said conveyor frame within said main support frame;

said belts, rollers, means for mounting and means for adjusting being mounted in said conveyor frame.

16. Apparatus according to claim 14, further comprising:

at least two parallel, transverse shafts for supporting said third conveying means;

a first transversely adjustable conveyor frame mounted on said shafts, said first conveyor frame supporting said first endless belt and said first and second rollers;

a second transversely adjustable conveyor frame mounted on said shafts, said second conveyor frame supporting said second endless belt and said third and fourth rollers; and lead screw means for moving said conveyor frames toward and away from each other to adjust the transverse spacing between said belts.

17. Apparatus according to claim 13, wherein one of said rollers is fixed against movement along said path; and the other of said rollers is mounted for movement along said path; and said means for adjusting the spacing comprises at least two guide rails extending parallel to said path; a roller support carriage mounted on said guide rails, said other roller being mounted on said roller support carriage; and lead screw means for moving said roller support carriage on said rails to adjust the spacing between said rollers.

18. Apparatus according to claim 13, wherein each bottom carton blank comprises flaps for at least partially covering the ends of the object after such flaps have been folded, the flaps for the ends including corner flaps to be folded around the corner of the object to partially cover the sides thereof, and further comprising means for folding the corner flaps around the corners of the object, said means for folding the corner flaps being mounted on said means for mounting said means for folding the bottom flaps at the leading and trailing sides of the object.

19. Apparatus according to claim 12, wherein each bottom carton blank comprises bottom flaps for at least partially covering the ends of the object after the flaps have been folded, the flaps for the ends including corner flaps to be folded around the corner of the object to partially cover the sides thereof, and further comprising means for folding the corner flaps around the corners of the object.

20. Apparatus according to claim 12, further comprising means for adjusting the transverse spacing between said first and second means for folding the flaps at the opposite ends of the bottom carton blank, to accommodate objects and blanks having different lengths.

21. Apparatus according to claim 12, further comprising means for adjusting the spacing along said path between said means for folding the flaps at the leading and trailing sides of the bottom carton blank, to accommodate objects and blanks having different widths.

22. Apparatus according to claim 12, further comprising means for raising and lowering said means for folding the flaps at the leading and trailing sides, relative to said path.

23. Apparatus according to claim 22, wherein said means for raising and lowering comprises:

a first transverse shaft for supporting said means for folding the flaps at the leading side;

a second transverse shaft for supporting said means for folding the flaps at the trailing side; and means for raising and lowering said first and second transverse shafts.

24. Apparatus according to claim 11, wherein said support rail means comprises a pair of support rails extending transverse to said path and said positioning carriage comprises a pair of carriage slides, one mounted on each support rail, and further comprising vacuum cup lifting means on each of said carriage slides and means for adjusting the spacing between said support rails to accommodate top blanks of different widths.

25. Apparatus according to claim 11, wherein said means for moving said positioning carriage comprises a cable cylinder connected between said carriage and said support rail means.

26. An apparatus for packaging objects of the type having a rectangular parallelepiped configuration with top, bottom, side and end surfaces, comprising a source of objects to be packaged; first conveying means for receiving a series of objects from said source and for moving the thus received objects along an essentially straight path, the sides of each object being at the leading and trailing edges thereof as the object moves along said path; a source of bottom carton blanks for a package, each bottom carton blank having a plurality of foldable bottom flaps at the edges thereof for use in forming the bottom of a package, the flaps of each bottom carton blank being arranged to at least partially cover the sides and the ends of the respective object after such flaps have been folded; means for positioning an object, as it moves along said path, at a position on a bottom carton blank which facilitates folding of the bottom flaps; means for stopping the bottom carton blanks and the objects positioned thereon in positions for folding the bottom flaps; a source of top carton blanks for a package, each top carton blank having a plurality of foldable top flaps at the edges thereof for use in forming the top of a package; means for positioning a top carton blank on each object at a position which facilitates folding the top flaps to form, in cooperation with a bottom carton blank, a package around the object; means for folding the bottom flaps upwardly adjacent each stopped object; means for folding the top flaps downwardly adjacent each stopped object to complete the package; and second conveying means for moving each completed package away from said means for folding and along said path, said means for folding the bottom flaps comprising third conveying means for moving bottom carton blanks and the objects positioned thereon along said path until stopped by said means for stopping, first and second means positioned on opposite sides of said third conveying means for folding the flaps at the opposite ends of the bottom carton blank upwardly adjacent the opposite ends of the respective object, means for folding the flaps at the leading side of the bottom carton blank upward adjacent the leading side of the respective object, means for folding the flaps at the trailing side of the bottom carton blank upwardly adjacent the trailing side of the respective object, and means for raising and lowering said means for folding the flaps at the leading and trailing sides relative to said path including a first transverse shaft for supporting said means for folding the flaps at the leading side, a second transverse shaft for supporting said means for folding the flaps at the trailing side and means for raising and lowering said first and second transverse shafts comprising an axially extending lift bar slidably received at opposite ends thereof in apertures provided therefor in said means for folding the flaps at the leading and trailing sides, means for supporting said lift bar to permit its upward and downward movement and means for moving said lift bar upwardly and downwardly whereby said means for folding are raised and lowered.

27. Apparatus for packaging a series of articles of the type comprising a bottom carton blank having a plurality of foldable bottom flaps at the edges thereof for use in forming the bottom of a package and an object positioned on the bottom carton blank, the objects having a rectangular parallelepiped configuration with top, bottom, sides and ends, comprising first conveying means for moving such articles along an essentially straight path; means for stopping the articles; a source of top carton blanks for the packages, each top carton blank having a plurality of foldable top flaps at the edges thereof for use in forming the top of the respective package; means for positioning top carton blanks on successive objects at a position which facilitates folding the top flaps to form, in cooperation with the respective bottom carton blanks, the packages around the resepective objects; means for folding the bottom flaps upwardly adjacent the respective stopped objects, said folding means including means for folding the bottom flaps at the leading and trailing edges of the respective bottom carton blanks and means for lowering said means for folding the bottom flaps at the leading and trailing edges; means for folding the top flaps downwardly adjacent the the respective stopped objects to complete the folding of the packages, including a guide element oriented upwardly relative to said path, a side folder carriage mounted on said guide element for upward and downward movement thereon, a horizontally extending flap folding bar mounted on said side folder carriage transverse to said path in position to contact a side flap of a top carton blank and fold it downwardly, and means for raising and lowering said side folder carriage including a first transverse shaft for supporting said means for folding the flaps at the leading side, a second transverse shaft for supporting said means for folding the flaps at the trailing side and means for raising and lowering said first and second transverse shafts including an axially extending lift bar slidably received at opposite ends thereof in apertures provided in said means for folding the flaps at the leading and trailing sides, means for supporting said lift bar to permit its upward and downward movement and means for moving said lift bar upwardly and downwardly whereby said means for folding the flaps at the leading and trailing sides are raised and lowered; and second conveying means for moving each completed package away from said folding means and along said path.

28. An apparatus for packaging objects of the type having a rectangular parallelepiped configuration with top, bottom, side and end surfaces, comprising a source of objects to be packaged; first conveying means for receiving a series of objects from said source and for moving the thus received objects along an essentially straight path; a source of bottom carton blanks for a package, each bottom carton blank having a plurality of foldable bottom flaps at the edges thereof for use in forming the bottom of a package; means for positioning an object, as it moves along said path, at a position on a bottom carton blank which facilitates folding of the bottom flaps; means for stopping successive bottom carton blanks and the objects positioned thereon in positions for folding the bottom flaps; a source of top carton blanks for a package, each top carton blank having a plurality of foldable top flaps at the edges thereof for use in forming the top of a package; means for positioning top carton blanks on successive objects at a position which facilitates folding the top flaps to form, in cooperation with the respective bottom carton blanks, packages around the respective objects; means for folding the bottom flaps upwardly adjacent each stopped object; means for folding the top flaps downwardly adjacent each stopped object to the complete the respective package, including a guide element oriented upwardly relative to said path, a side folder carriage mounted on said first guide element for upward and downward movement thereon, a horizontally extending flap folding bar mounted on said side folder carriage transverse to said path in position to contact a side flap on a top carton blank and fold it downwardly, means for raising and lowering said side folder carriage and means supported by said side folder carriage for pressing a side flap of a top carton blank against an upwardly extending side flap of a bottom carton blank; and second conveying means for moving each completed package away from said means for folding and along said path.

29. Apparatus according to claim 28, further comprising means supported by said side folder carriage for pressing a top blank along its side edge to expel entrapped air from the underlying object.

30. Apparatus according to claim 28, further comprising means for applying adhesive to the side flaps of each top carton blank before said means for pressing a side flap is actuated.

31. Apparatus according to claim 28, wherein each top carton blank comprises flaps for at least partially covering the sides of an object after the flaps have been folded, the flaps for the sides including corner flaps to be folded around the corner of the object to partially cover the ends thereof; further comprising means supported by said carriage for folding the corner flaps around the corners of the object.

32. Apparatus according to claim 28, wherein said means for folding the flaps on the top carton blanks further comprises a second guide element oriented upwardly relative to said path, an end folder carriage mounted on said second guide element for upward and downward movement thereon, a horizontally extending flap folding bar mounted on said end folder carriage parallel to said path in position to contact an end flap of a top carton blank and fold it downward, means for raising and lowering said end folder carriage, and means supported by said end folder carriage for pressing an end flap of a top carton blank against an upwardly extending end flap of a bottom carton blank.

33. Apparatus according to claim 32, further comprising means for applying adhesive to the end flaps of each bottom carton blank before said means for pressing an end flap is actuated.

34. Apparatus according to claim 32, further comprising means supported by said end folder carriage for pressing a top carton blank along its end edge to expel entrapped air from the underlying object.

35. An apparatus for packaging objects of the type having a rectangular parallelepiped configuration with top, bottom side and end surfaces, comprising a source of objects to be packaged; first conveying means for receiving a series of objects from said source and for moving the thus received objects along an essentially straight path, the sides of each object being at the leading and trailing edges thereof as the object moves along said path; a source of bottom carton blanks for packages, each bottom carton blank having a plurality of foldable bottom flaps at the edges thereof for use in forming the bottom of a package, the flaps of each bottom carton blank being arranged to at least partially cover the sides and the ends of the respective object after such flaps have been folded; means for positioning an object, as it moves along said path, at a position on a bottom carton blank which facilitates folding of the bottom flaps; means for stopping the bottom carton blanks and the objects positioned thereon in positions for folding the bottom flaps; a source of top carton blanks for packages, each top carton blank having a plurality of foldable top flaps at the edges thereof for use in forming the top of a package; means for positioning a top carton blank on each object at a position which facilitates folding the top flaps to form, in cooperation with a bottom carton blank, a package around the respective object; means for folding the bottom flaps upwardly adjacent each stopped object; means for folding the top flaps downwardly adjacent each stopped object to complete the respective package, including a first guide element oriented upwardly relative to said path, a side folder carriage mounted on said first guide element for upward and downward movement thereon, a horizontally extending flap folding bar mounted on said side folder carriage transverse to said path in position to contact a side flap of a top carton blank to fold it downwardly and means for raising and lowering said side folder carriage; and second conveying means for moving each completed package away from said means for folding and along said path, said means for folding the bottom flaps comprising third conveying means for moving bottom carton blanks and the objects positioned thereon along said path until stopped by said means for stopping, first and second means positioned on opposite sides of said third conveying means for folding the flaps at the opposite ends of the bottom carton blanks upwardly adjacent the opposite ends of the respective objects, means for folding the flaps at the leading sides of the bottom carton blanks upwardly adjacent the leading sides of the respective objects, means for folding the flaps at the trailing sides of the bottom carton blanks upwardly adjacent the trailing sides of the respective objects, and means for lowering said means for folding the bottom flaps at the leading and trailing edges.

36. Apparatus according to claim 35, wherein said means for raising and lowering comprises:

a first transverse shaft for supporting said means for folding the flaps at the leading side;

a second transverse shaft for supporting said means for folding the flaps at the trailing side; and means for raising and lowering said first and second transverse shafts.

37. Apparatus according to claim 36, wherein said means for raising and lowering said transverse shafts comprise an axially extending lift bar slidably received at opposite ends thereof in apertures provided in said means for folding the flaps at the leading and trailing sides; means for supporting said lift bar to permit its upward and downward movement; and means for moving said lift bar upward and downward whereby said means for folding are raised and lowered.

38. Apparatus for packaging a series of articles of the type comprising a bottom carton blank having a plurality of foldable bottom flaps at the edges thereof for use in forming the bottom of a package and an object positioned on the bottom carton blank, the object having a rectangular parallelepiped configuration with top, bottom, sides and ends, the flaps of the bottom carton blank being arranged to at least partially cover the sides and the ends of the respective object after such flaps have been folded, comprising first conveying means for moving the articles along an essentially straight path, the sides of the objects being at the leading and trailing edges thereof as the objects move along said path; means for stopping the articles; a source of top carton blanks for the packages, each top blank having a plurality of foldable top flaps at the edges thereof for use in forming the top of the respective package; means for positioning a top carton blank on each object at a position which facilitates folding the top flaps to form, in cooperation with the respective bottom carton blank, the package around the object; means for folding the bottom flaps upward adjacent the respective stopped objects; means for folding the top flaps downward adjacent each stopped object, to complete the folding of the package; and second conveying means for moving each completed package away from said means for folding, along said path, said means for folding the bottom flaps comprising third conveying means for moving bottom carton blanks and the objects positioned thereon along said path until stopped by said means for stopping, first and second means positioned on opposite sides of said third conveying means for folding the bottom flaps at the opposite sides of a bottom carton blank upward adjacent the opposite ends of the respective object, means for folding the bottom flaps at the leading side of a bottom carton blank upward adjacent the leading side of the respective object, means for folding the bottom flaps at the trailing side of a bottom carton blank upward adjacent the trailing side of the respective object, and means for raising and lowering said means for folding the flaps at the leading and trailing sides relative to said path, said means for raising and lowering comprising a first transverse shaft for supporting said means for folding the flaps at the leading side, a second transverse shaft for supporting said means for folding the flaps at the trailing side, and means for raising and lowering said first and second transverse shafts comprising an axially extending lift bar slidably received at opposite ends thereof in apertures provided therefor in said means for folding the flaps at the leading and trailing sides, means for supporting said lift bar to permit its upward and downward movement, and means for moving said lift bar upwardly and downwardly whereby said means for folding are raised and lowered.

39. Apparatus according to claim 38, wherein said third conveying means comprises a first endless belt, a first roller over which said belt is trained, a second roller over which said belt is trained at a position spaced along said path from said first roller, means for supporting said first and second rollers, means for mounting said means for folding the bottom flaps at the trailing side at a position fixed relative to said first roller, means for mounting said means for folding the bottom flaps at the leading side at a position fixed relative to said second roller, and means for adjusting the spacing along said path between said rollers, whereby the spacing is adjusted between said means for folding the bottom flaps at the leading and trailing sides to accommodate objects and blanks having different widths.

40. Apparatus according to claim 39, further comprising a second endless belt spaced from and parallel to said first endless belt; a third roller and a fourth roller over which said second belt is trained; means for mounting said first and second means for folding the flaps at the opposite ends of the bottom blank, at positions fixed relative to said first and second endless belts; and means for adjusting the transverse spacing between said belts, whereby the transverse spacing is adjusted between said first and second means for folding the bottom flaps at the opposite ends of the bottom carton blanks, to accommodate objects and blanks having different lengths.

41. Apparatus according to claim 40, further comprising a main support frame, a transversely adjustable conveyor frame, and means for adjustably supporting said conveyor frame within said main support frame; said belts, rollers, means for mounting and means for adjusting being mounted in said transversely adjustable frame.

42. Apparatus according to claim 39, further comprising:

at least two parallel, transverse shafts for supporting said third conveying means;

a first transversely adjustable conveyor frame mounted on said shafts, said first conveyor frame supporting said first endless belt and said first and second rollers;

a second transversely adjustable conveyor frame mounted on said shafts, said second conveyor frame supporting said second endless belt and said third and fourth rollers; and lead screw means for moving said frames toward and away from each other to adjust the transverse spacing between said belts.

43. Apparatus according to claim 39, wherein one of said rollers is fixed against movement along said path; and the other of said rollers is mounted for movement along said path; and said means for adjusting the spacing comprises at least two guide rails extending parallel to said path; a roller support carriage mounted on said guide rails, said other roller being mounted on said roller support carriage; and lead screw means for moving said roller support carriage on said rails to adjust the spacing between said rollers.

44. Apparatus according to claim 39, wherein the flaps of each bottom blank are arranged to at least partially cover the ends of the object after such flaps have been folded, the flaps for the ends including corner flaps to be folded around the corner of the object to partially cover the sides thereof and further comprising means for folding the corner flaps around the corners of the object, said means for folding the corner flaps being mounted on said means for mounting said means for folding the flaps at the leading and trailing sides of the object.

45. Apparatus according to claim 38, wherein the flaps of each bottom carton clank are arranged to at least partially cover the ends of the respective object after such flaps have been folded, the flaps for the ends including corner flaps to be folded around the corner of the object to partially cover the sides thereof and further comprising means for folding the corner flaps around the corners of the object.

46. Apparatus according to claim 38, further comprising means for adjusting the transverse spacing between said first and second means for folding the flaps at the opposite ends of the bottom carton blanks to accommodate objects and blanks having different lengths.

47. Apparatus according to claim 38, further comprising means for adjusting the spacing along said path between said means for folding the flaps at the leading and trailing sides of the bottom carton blanks to accommodate objects and blanks having different widths.

48. Apparatus for packaging a series of articles of the type comprising a bottom carton blank having a plurality of foldable bottom flaps at the edges thereof for use in forming the bottom of a package and object positioned on the bottom cartp carton blanks for the packages, each top carton blank having a plurality of foldable top flaps at the edges thereof for use in forming the tops of the packages; means for positioning successive top carton blanks on discrete objects at a position which facilitates folding the top flaps to form, in cooperation with the respective bottom carton blanks, the packages around the respective objects; means for folding the bottom flaps upwardly adjacent the respective stopped objects; means for folding the top flaps downwardly adjacent the respective stopped objects to complete the folding of the respective packages, including a guide element oriented upwardly relative to said path, a side folder carriage mounted on said guide element for upward and downward movement thereon, a horizontally extending flap folding bar mounted on said side folder carriage transverse to said path in position to contact a side flap of a top carton blank and fold it downwardly, means for raising and lowering said side folder carriage and means supported by said side folder carriage for pressing a side flap of a top carton blank against an upwardly extending side flap of the respective bottom carton blank; and second conveying means for moving each completed package away from said means for folding and along said path.

49. Apparatus according to claim 48, further comprising means supported by said side folder carriage for pressing a top blank along its side edge to expel entrapped air from the underlying object.

50. Apparatus according to claim 48, further comprising means for applying adhesive to the side flaps of each top carton blank before said first means for pressing a side flap is actuated.

51. Apparatus according to claim 48, wherein the flaps of each top carton blank are arranged to at least partially cover the sides of an object after the flaps have been folded, the flaps for the sides including corner flaps to be folded around the corner of the object to partially cover the ends thereof and further comprising means supported by said side folder carriage for folding the corner flaps around the corners of the object.

52. Apparatus according to claim 48, wherein said means for folding the flaps of the top carton blanks further comprises a second guide element oriented upwardly relative to said path, an end folder carriage mounted on said second guide element for upward and downward movement thereon, a horizontally extending flap folding bar mounted on said end folder carriage parallel to said path in position to contact an end flap of a top carton blank and fold it downward, means for raising and lowering said end folder carriage and means supported by said end folder carriage for pressing an end flap of a top carton blank against an upwardly extending flap of a bottom carton blank.

53. Apparatus according to claim 52, further comprising means supported by said end folder carriage for pressing a top carton blank along its end edge to expel entrapped air from the underlying object.

54. Apparatus according to claim 52, further comprising means for applying adhesive to the end flaps of each bottom carton blank before said means for pressing an end flap is actuated.

* * * * *